US005162845A

United States Patent [19]

Ariyama et al.

[11] Patent Number: 5,162,845

[45] Date of Patent: Nov. 10, 1992

[54] IMAGE FORMING APPARATUS

[75] Inventors: Takayuki Ariyama, Toyokawa; Hirofumi Hasegawa, Hadano; Motohiro Yamada, Okazaki; Takashi Gonda, Aichi, all of Japan

[73] Assignee: Minolta Camera Kabushiki Kaisha, Osaka, Japan

[21] Appl. No.: 725,289

[22] Filed: Jul. 3, 1991

[30] Foreign Application Priority Data

Jul. 5, 1990 [JP] Japan ..... 2-178576

[51] Int. Cl.[5] ..... G03G 15/00

[52] U.S. Cl. ..... 355/200; 355/46; 346/44; 361/391; 271/303

[58] Field of Search ..... 346/44, 134; 355/46, 355/200, 309, 202, 321, 319; 361/391, 394; 271/186, 291, 65, 303

[56] References Cited

U.S. PATENT DOCUMENTS

| | | | |
|---|---|---|---|
| 4,045,135 | 8/1977 | Doi et al. | 355/271 |
| 4,284,345 | 8/1981 | Sugiyama et al. | 355/299 |
| 4,587,532 | 5/1986 | Asano | 271/303 |
| 4,641,947 | 2/1987 | Ishida et al. . | |
| 4,814,817 | 3/1989 | Nishijima et al. . | |
| 4,972,236 | 11/1990 | Hasegawa | 355/319 |

*Primary Examiner*—Richard L. Moses
*Assistant Examiner*—P. Stanzione
*Attorney, Agent, or Firm*—Willian Brinks Olds Hofer Gilson & Lione

[57] ABSTRACT

An upper unit relative to a unit positioned lower than the upper unit is movably supported between an operating position above the lower unit and a non-operating position retracted from the lower unit.

12 Claims, 27 Drawing Sheets

IMAGE FORMING APPARATUS

BACKGROUND OF THE INVENTION

1. Technical Field of the Invention

The present invention relates to an image forming apparatus such as printers, and more particularly, to an image forming apparatus wherein a plurality of image forming units are connected through their sheet transport units which are connected with each other, and a required number of image forming units are subsequently utilized for feeding a sheet in order to form images.

2. Description of Related Art

In recent years, there has been a growing demand for printers to be more sophisticated by adding such various functions as double-side printing function, composite printing function, color printing function and sorting function. On the other hand, a compact and inexpensive apparatus is also required though it is provided with only a single function, and a compact compact apparatus in low height has actually been introduced. However, for such an apparatus with a single function, there is not prepared any optional unit of the above-mentioned functions to be attached to the apparatus. The user who has been using a printer which is provided with a single function is, therefore, required to prepare a high-grade apparatus in place of the apparatus of a single function when it becomes necessary for the user to utilize the sophisticated functions. Since the high-grade apparatus is capable of fulfilling a function of the printer of single function, the printer with a single function which had been used becomes useless for the user. It will, therefore, be advantageous if the printer with a single function is used by adding the sophisticated functions to meet requirements.

For constructing a high-grade printer, it may advantageously be arranged to provide an inexpensive and versatile printer with various functions basing on the inexpensive printer with a single function.

In U.S. Pat. No. 4,972,236, there is disclosed an image forming apparatus wherein a plurality of image forming units are vertically stacked, and the paper feeding section and paper discharging section of an upper and lower image forming units are connected by a paper conveying unit provided with changeover means capable of changing over paper conveying path.

According to the image forming apparatus, double-side printing function, composite printing function, color printing function and the like may be provided by conveying sheets of copy paper in various modes with the paper conveying unit. A sorting function may also be provided by utilizing the paper conveying unit which is provided with a sorter section.

In the image forming apparatus disclosed in the official gazette, however, when a sheet is jammed in the paper feeding path of the image forming unit and in the paper conveying unit other than the uppermost image forming unit and the paper conveying unit or when various maintenance operations are conducted, it is necessary to clear the jam by opening upper frame of the image forming unit and opening upper cover of the paper conveying unit after each unit stacked therein has been removed which causes the operations more complicated.

SUMMARY OF THE INVENTION

A primary object of the present invention to provide an image forming apparatus wherein a plurality of single functions of image forming means and sheet transport means are vertically stacked to have a versatile function so that jam clearing and maintenance operations can be easily performed.

These and other objects and features of the present invention will become more apparent from the following description taken in conjunction with the accompanying drawings which illustrate specific embodiments of the invention.

DESCRIPTION OF THE PREFERRED EMBODIMENTS

Several embodiments of the present invention will now be described hereinafter referring to accompanying drawings.

FIGS. 1 through 10 show a first embodiment of the present invention, and in FIGS. 39 through 45, there are illustrated other mechanical and electrical structures and controls to be applied to the embodiment.

Figure 1:
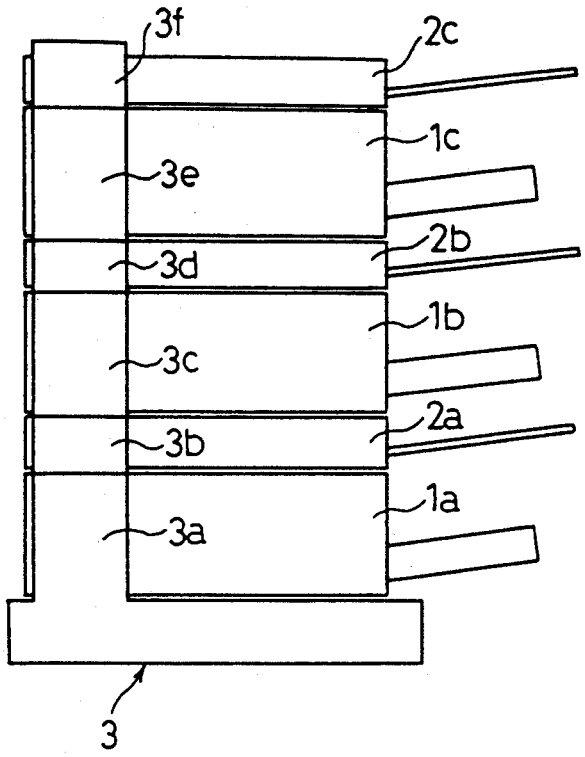
FIG. 1 is a front view showing the whole image forming apparatus in a first embodiment of the present invention.

In FIG. 1, reference numerals 1*a*, 1*b*, 1*c* represent lower, middle, upper image forming units which are arranged to be vertically stacked and constituting a small sized page printer provided with a single function.

Between the lower image forming unit 1*a* and the middle image forming unit 1*b*, and between the middle image forming unit 1*b* and the upper image forming unit 1*c*, there are provided lower and middle paper transport units 2*a* and 2*b* whereby the paper discharge section of the lower image forming unit and the paper feed section of the upper image forming unit are connected. An upper paper transport unit 2*c* in the same construction is also provided on the upper image forming unit 1*c*. The units 1*a*–1*c* and 2–2*c* are supported by a support 3 wherein support sections 3*a*–3*f* are vertically provided for independently support each one of these units.

Figure 2:
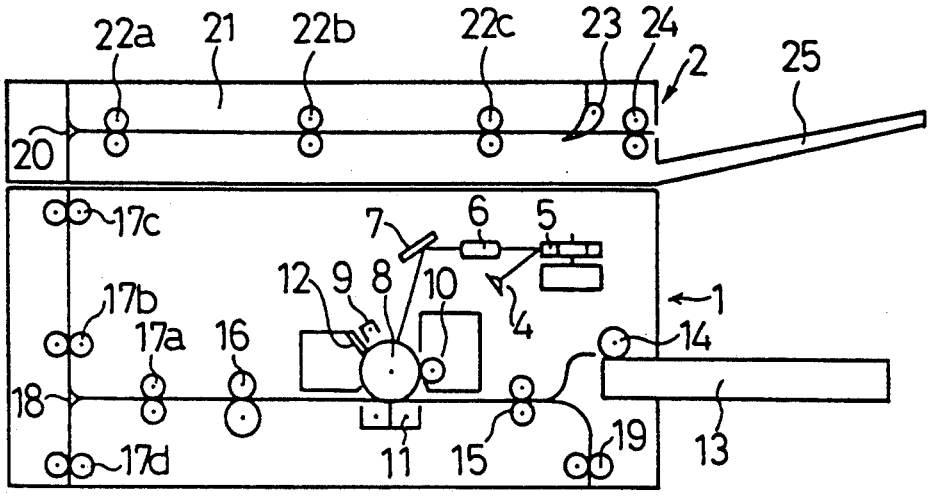
FIG. 2 is a schematic structural view showing an image forming unit and a sheet transport unit of the image forming apparatus.

Construction of each image forming unit 1 (1*a*, 1*b*, 1*c*) will now be described referring to FIG. 2. A laser beam modulated by an unillustrated control section and irradiated from a semiconductor laser 4 is deflected by a polygon mirror 5 and an image is formed on a photoconductor 8 through a correction lens 6 and a reflection mirror 7. The photoconductor 8 is electrified by a charger 9, and a latent image is formed by a laser beam to be developed by a developing unit 10. A visualized image formed by the development is then transferred onto a sheet by a transfer charger 11 from the photoconductor 8, and the residual toner on the photoconductor 8 is thereafter removed by a cleaner 12.

A sheet is fed by a paper feed roller 14 from a paper feed cassette 13. The sheet fed is transported to a transfer section by a register roller 15 timely with an image on the photoconductor 8. An image on the sheet which is transferred onto a sheet in the transfer section is fixed in a fixing section 16 and the sheet is discharged by transport rollers 17*a*–17*d* and separation claw 18 onto upper or lower surface of the unit. At a position under the paper feed cassette 13, there is provided a paper re-feeding roller 19 for receiving and supplying a sheet sent from the lower surface of the unit to the register roller 15.

Each one of the sheet transport units 2 (2*a*, 2*b*, 2*c*) receives a sheet discharged from upper or lower surfaces of the image forming unit 1 into a horizontal paper feed transport path 21 through a separation claw 20 to convey it to the paper feed side of the image forming unit 1 by transport rollers 22*a*–22*c*. The sheet is thereafter discharged onto a paper discharge tray 25 by discharge rollers 24 provided at the end portion. A separation claw 23 is provided this side of the discharge roller 24 whereby a sheet is discharged onto upper surface face to send it to the paper re-feeding roller 19 of the image forming unit 1.

Figure 39:
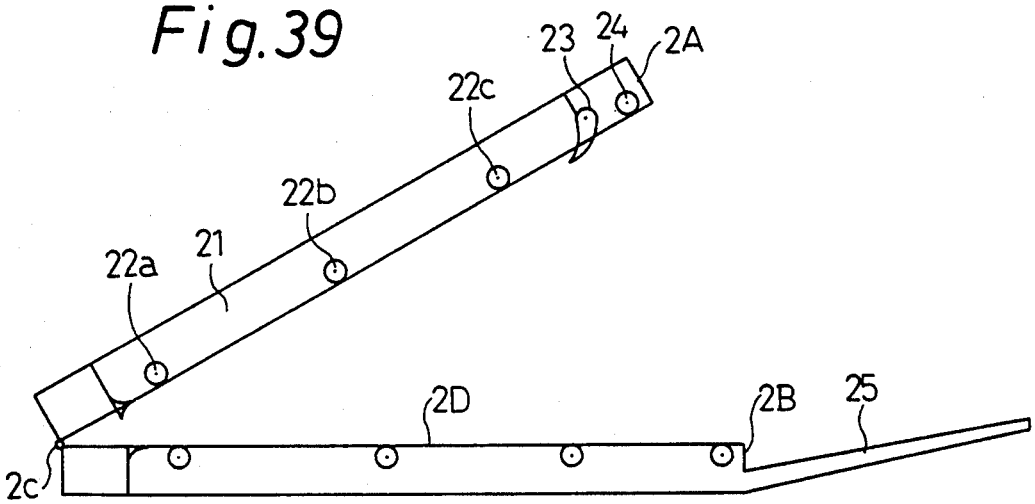
FIG. 39 is a concrete structural view showing a means which opens and closes a sheet transport unit to be applied to the first embodiment of the present invention.
Figure 40:
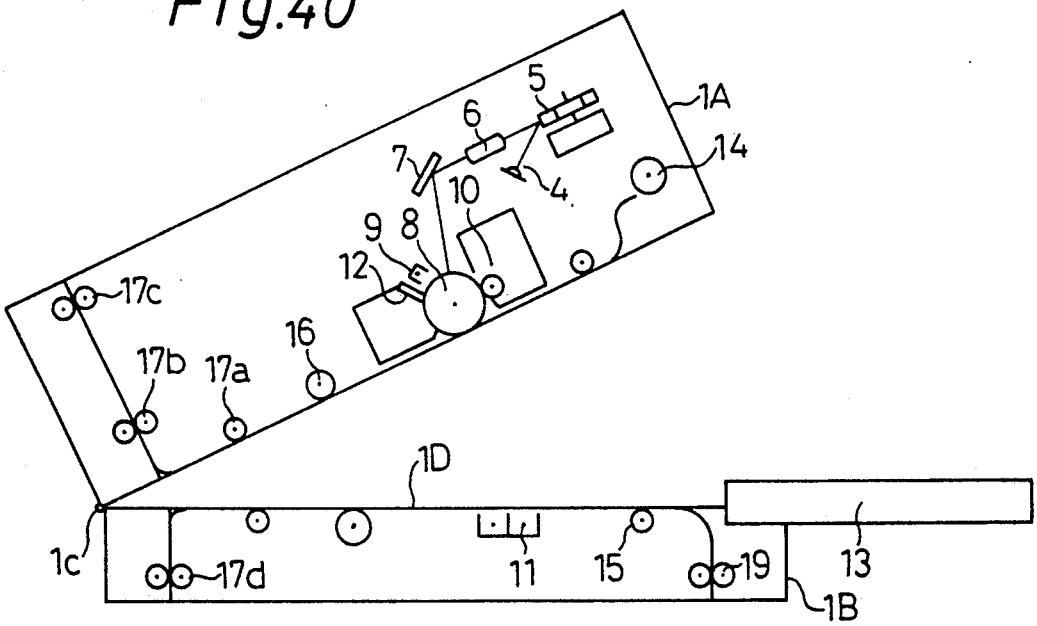
FIG. 40 is a concrete structural view showing a means which opens and closes an image forming unit to be applied to the first embodiment of the present invention.

As illustrated in FIGS. 39 and 40, each image forming unit 1 and paper transport unit 2 are divisible into upper frames 1A and 2A, and lower frames 1B and 2B. By lifting the upper frames 1A, 2A upward with points 1C and 2C as fulcrums, paper transport paths 1D and 2D are exposed to the outside. Under the state that the paper transport paths are opened, maintenance operation can be easily conducted for clearing paper jam and the like. In U.S. Pat. No. 4,045,135 and U.S. Pat. No. 4,284,345, apparatuses constructed in such a manner are disclosed.

Figure 5:
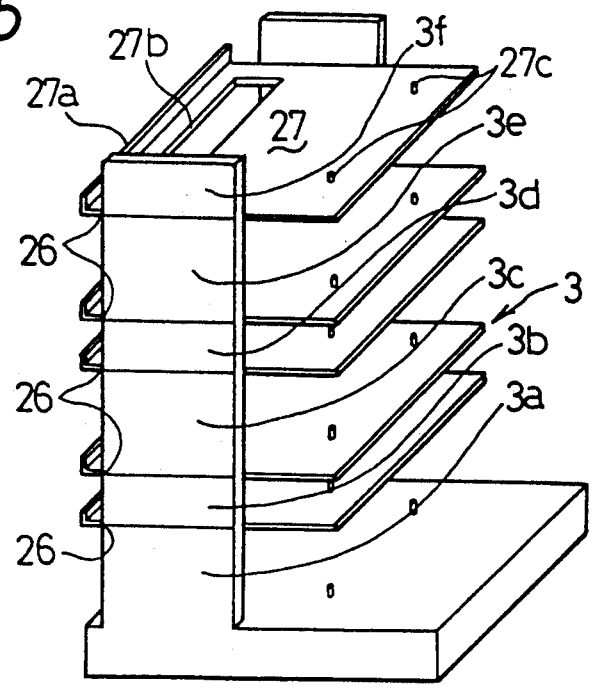
FIG. 5 is a perspective view showing a support means which supports each unit of an image forming apparatus.
Figure 6:
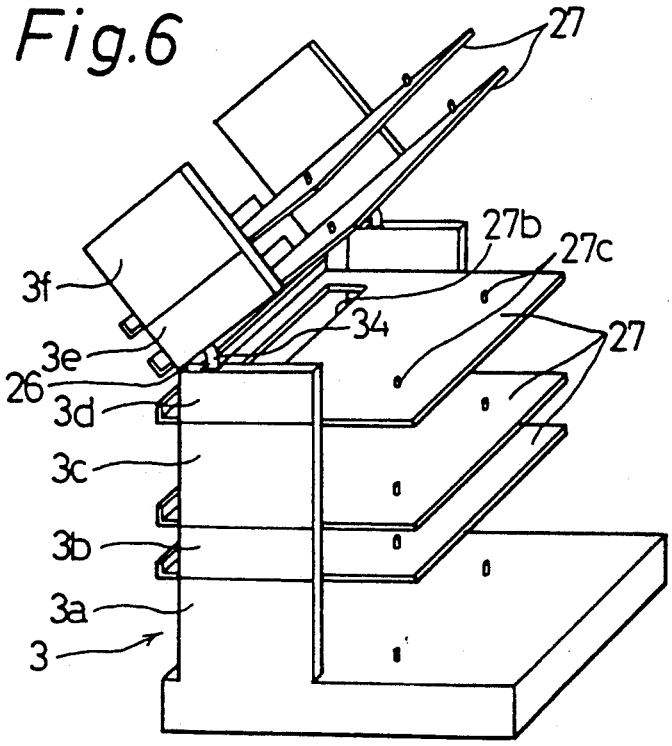
FIG. 6 is a perspective view showing a state of a support means when a unit is pivotally retracted as shown in FIG. 3.

In a support unit 3, as shown in FIGS. 5 and 6, the upper and lower edges of base end portion in each support section 3a–3f are pivotally supported with a fulcrum 26 so that the upper support section may be pivotally retracted upward, and each support section 3b–3f from the second stage is provided with a support tray 27 for supporting each unit.

In each support tray 27, there is provided a slot 27b for guiding a sheet discharged from the image forming unit 1 or paper transport unit 2 on the lower stage to the unit supported by the support tray 27. Each support tray 27 is further provided with a side wall 27a which is in contact with a side plane of a unit to be supported at the edge on the side of the fulcrum 26. On the upper surface of each support tray 27 and the lowermost support section 3a, protrusions 27c are provided to engage with concave sections provided on the bottom plane of each unit. The position of each image forming unit 1 and each paper transport unit 2 are firmly set with the side wall 27a and protrusions 27c. The side wall 27a and protrusions 27c are provided at the positions where the paper transport path of each unit 1 and 2 can be accurately connected when each support section 3a–3f is set to each image forming unit 1 and paper transport unit vertically stacked as illustrated in FIG. 1.

Figure 7:
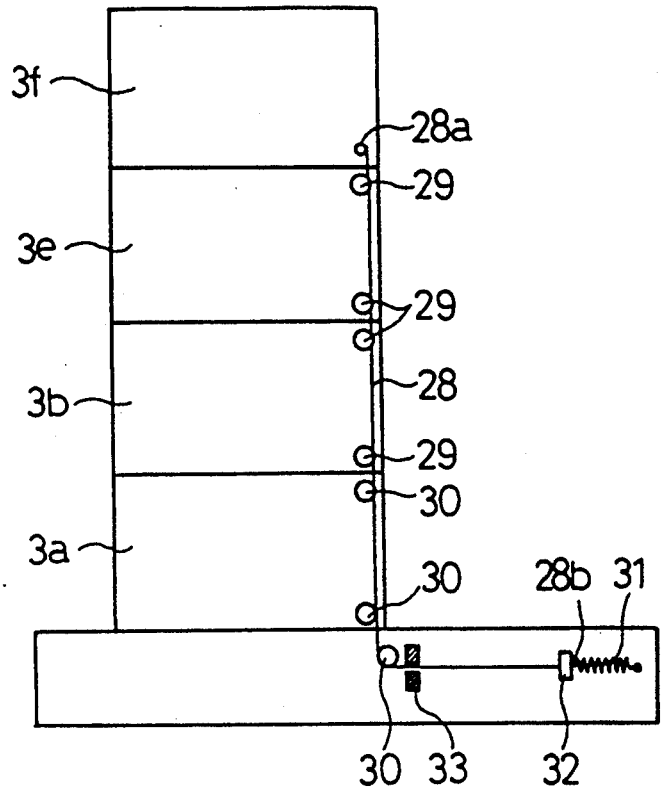
FIG. 7 is a front view showing a mechanism which pivotally retracts each unit so as to have only an upper space of a required unit to be opened.
Figure 8:
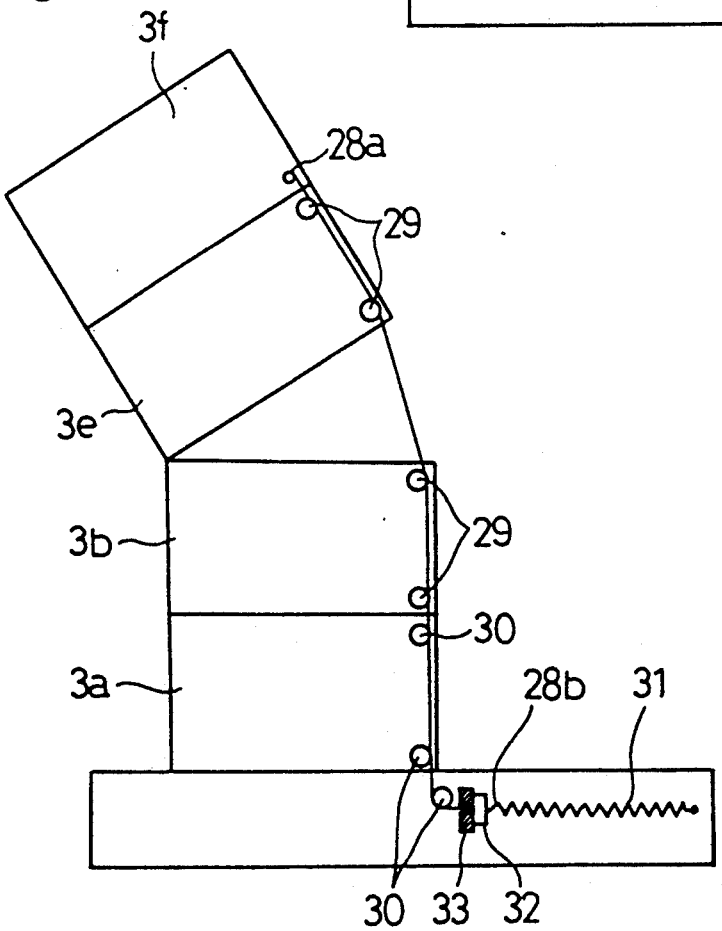
FIG. 8 is a front view showing an operating condition of the mechanism in FIG. 7.

It is feared that the balance of the entire apparatus is lost when any one of the support section 3a–3f or plural support sections are pivotally retracted. In order to avoid such a trouble, the entire amount of retracting movement of each support section 3a–3f is regulated. More particularly, one end 28a of a regulating wire 28 is fixed to the lower leading end of the uppermost support section 3f as illustrated in FIGS. 7 and 8. The regulating wire 28 is extended downward winding each guide roller 29 provided on the upper and lower leading end portions of each support section 3e–3b and the guide roller 30 provided on the lowermost support section 3a (for simplifying the drawings, support sections 3d and 3c are omitted in FIGS. 7 and 8 and also in FIGS. 9 and 10). The other end 28b of the regulating wire 28 is connected to a spring 31 and is elastically held. At this end 28b of the regulating wire 28, an engaging piece 32 is fixed and a stopper 33 is also provided for engaging with the spring 31 when it is extended for a predetermined length. When one of the support section 3e, for instance, is pivotally retracted upward as shown in FIG. 8, the engaging piece 32 is moved until it engages with the stopper 33 and is stopped. Under the state, other support section can not be moved.

Figure 9:
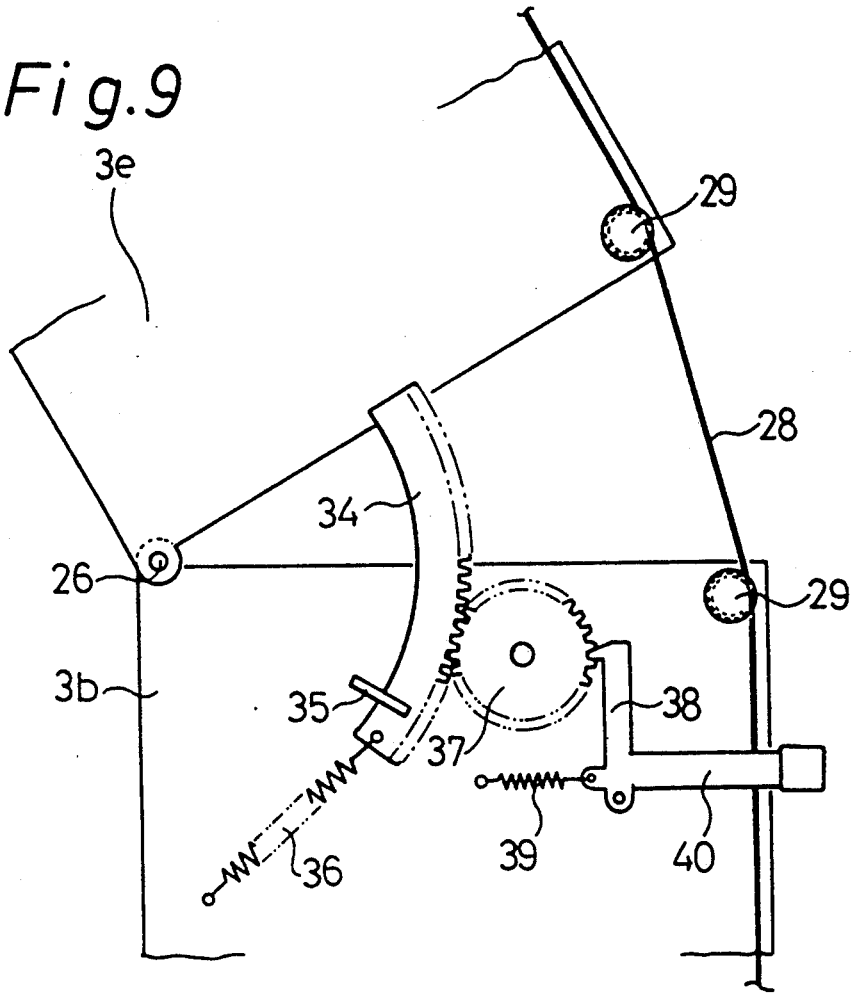
FIG. 9 is a front view showing a mechanism which holds a support means capable of releasing the support means from a pivotally retracted condition.

In order to stop a desired support section under the state it is pivotally retracted, an arc rack 34 is extended centering the fulcrum 26 from the upper support section 3e toward the lower support section 3b as illustrated in FIG. 9, and a slip preventing stopper 35 is provided at the lower end to be pulled downward by a spring 36. A pinion 37 is engaged with the rack 34, and a one-way engaging claw 38 urged by a spring 39 is provided to obstruct the rotation of the pinion 37 accompanied by the downward movement of the rack 34. A releasing lever 40 is further provided for releasing an action of the one-way engaging claw 38.

Figure 3:
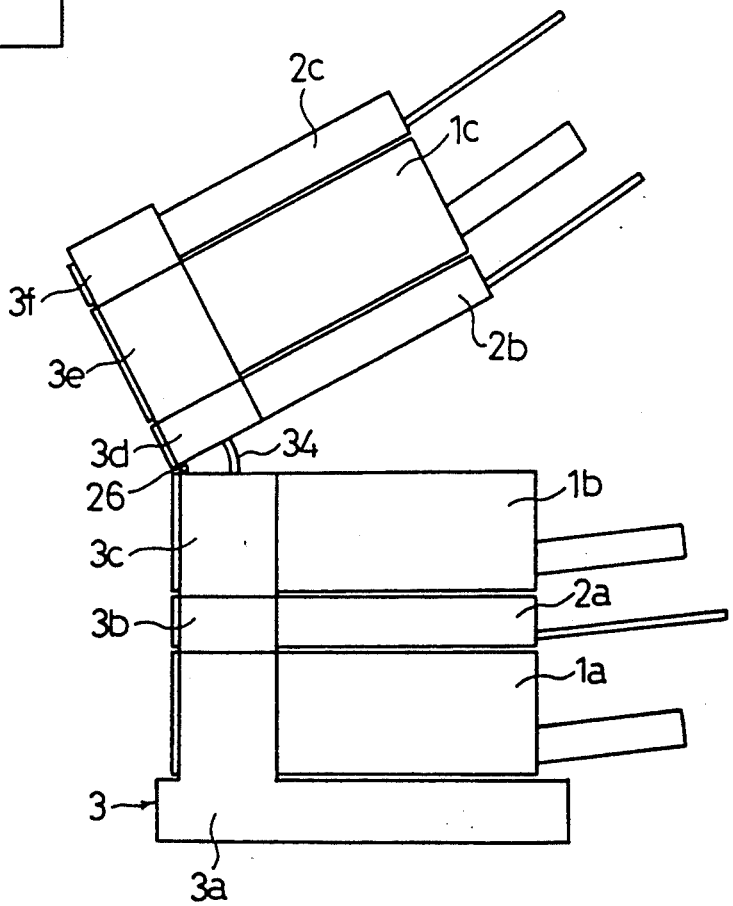
FIG. 3 is a front view showing an image forming apparatus wherein an upper unit stacked above a unit at a certain stage is pivotally upwardly retracted.
Figure 4:
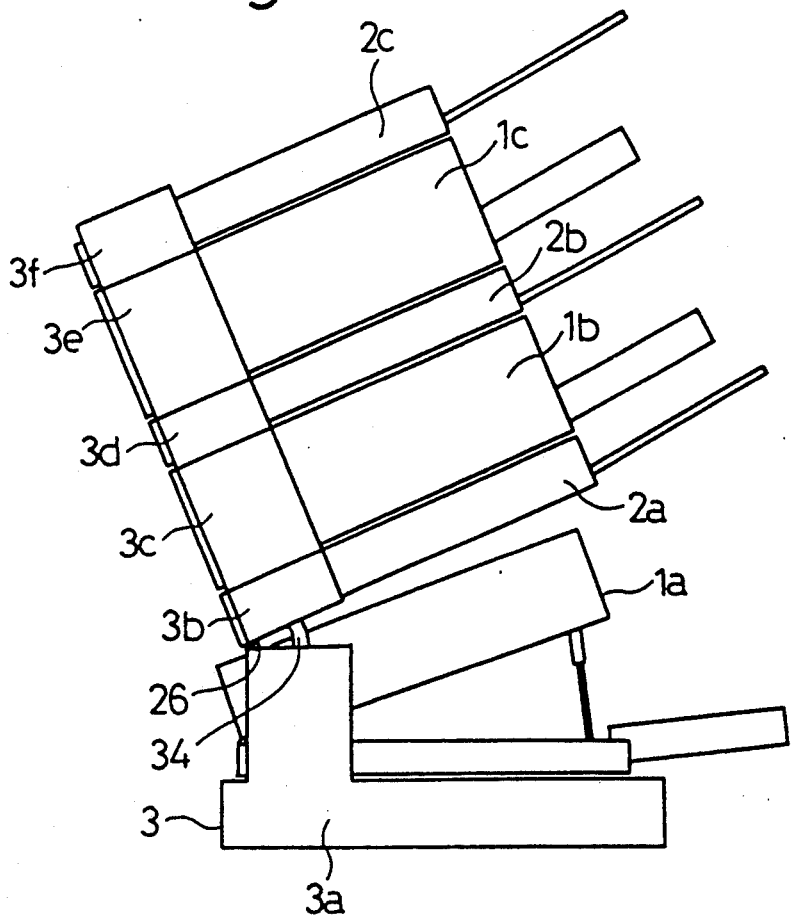
FIG. 4 is a front view showing an image forming apparatus wherein a paper feed path of an image forming unit is opened.
Figure 10:
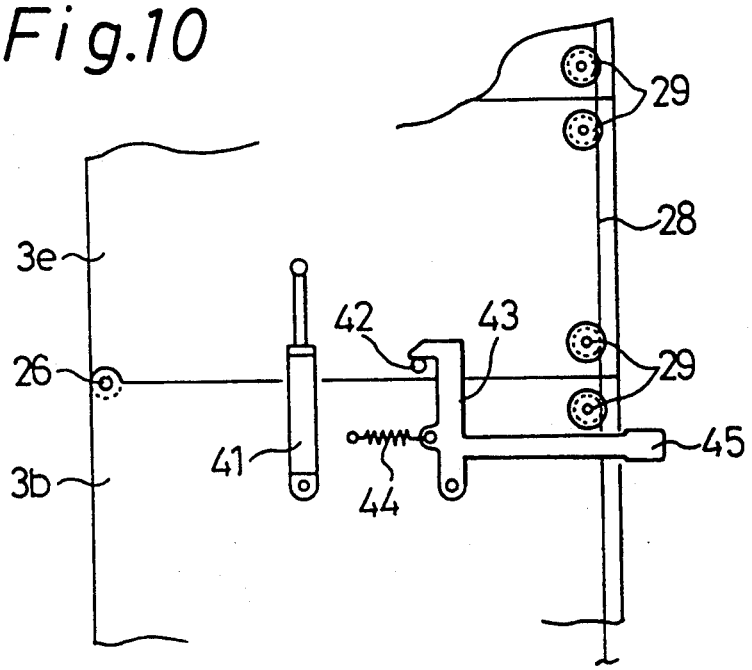
FIG. 10 is a front view showing other mechanisms of the hold means.
Figure 11:
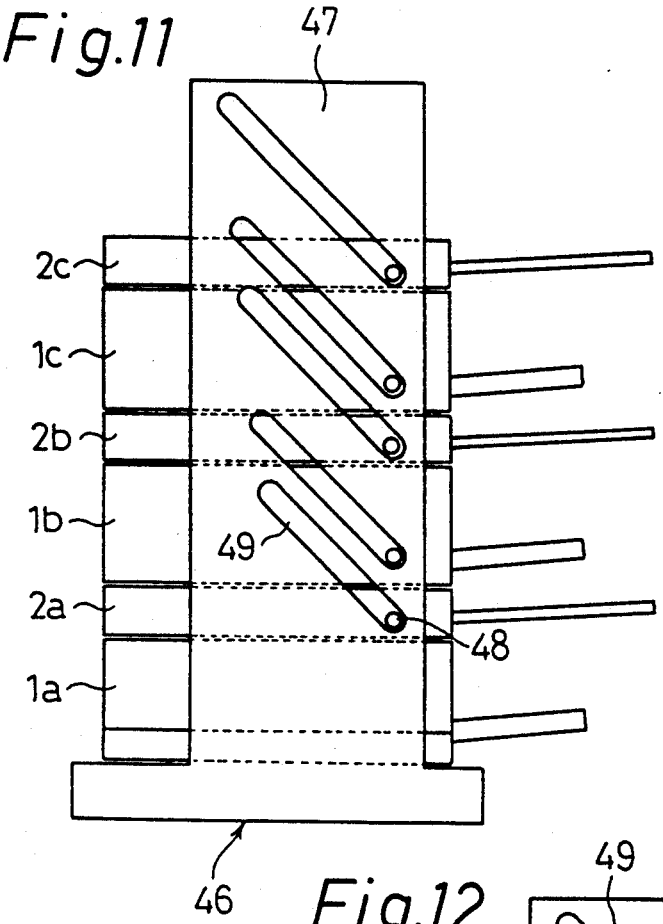
FIG. 11 is a front view showing the whole image forming apparatus in a second embodiment of the present invention.
Figure 41:
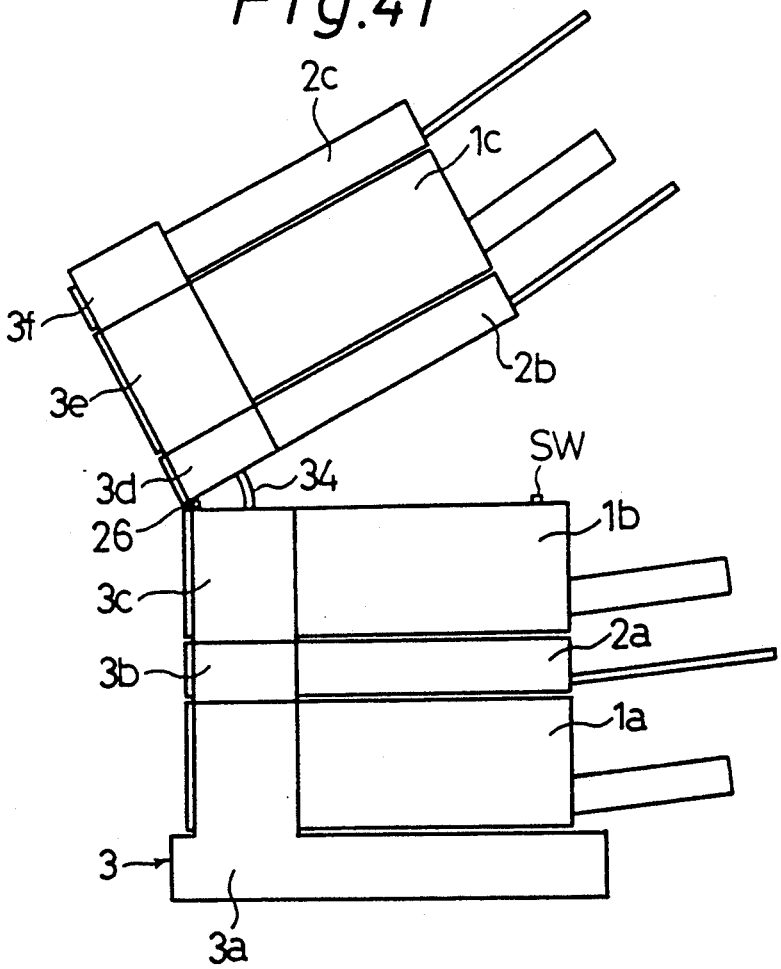
FIG. 41 is a concrete structural view showing a means for detecting each unit to be applied to the first embodiment of the present invention whether each unit is retracted or not.

With the construction as described above, when a jam clearing or maintenance operation is conducted for the second stage image forming unit 1b, for instance, the upper space of the image forming unit 1b can be opened by pivotally retracting the support section 3d upward as shown in FIG. 3 just like the case of a maintenance operation for a single stage image forming unit. FIG. 4 shows a condition when the upper space of the lowermost image forming unit la is opened and a jam clearing or maintenance operation is conducted by opening its upper frame. In the exemplified drawing of FIG. 9, the retracted support section 3e is held by the arc rack 34 and the pinion 37 with the one-way engaging claw 38, however, it may also be arranged, as shown in FIG. 10, to provide a damper 41 between the upper support section 3e and the lower support section 3b to energize the support section 3e upward with a force balanced between the weight of the upper support sections 3e and 3f with further with further arrangement of a releasing lever 45 of an engaging claw 43 urged by a spring 44 at a passive engaging section 42 so that the upper and lower sections 3e and 3b are locked when they are stacked. As illustrated in FIG. 41, it may also be arranged to provide a switch on each unit for detecting whether the upper unit is retracted or not in order to prohibit a paper feed operation to the upper unit when the upper unit is being retracted.

Figure 42:
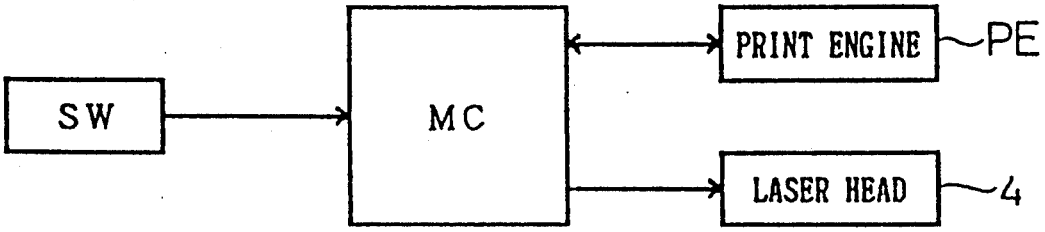
FIG. 42 shows a control circuit of an image forming unit when a detecting means is utilized.
Figure 43:
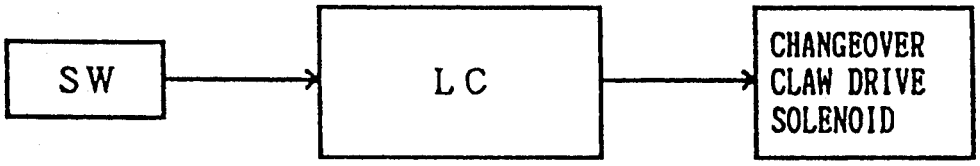
FIG. 43 is shows a control circuit of a paper transport unit when a detecting means is utilized.
Figure 44:
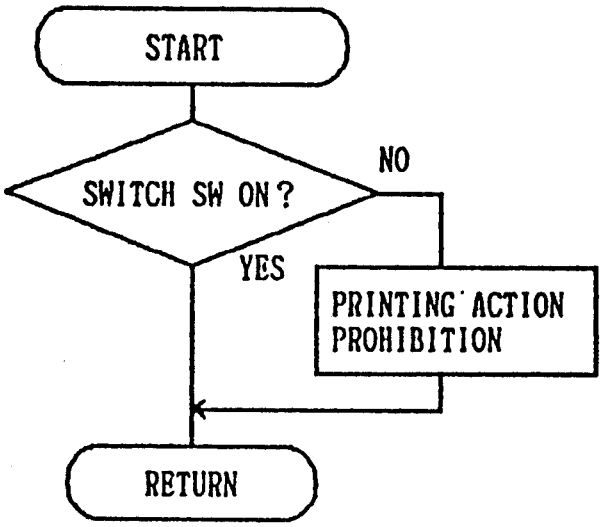
FIG. 44 is a flow chart showing a subroutine of a control program in the control circuit of an image forming unit.
Figure 45:
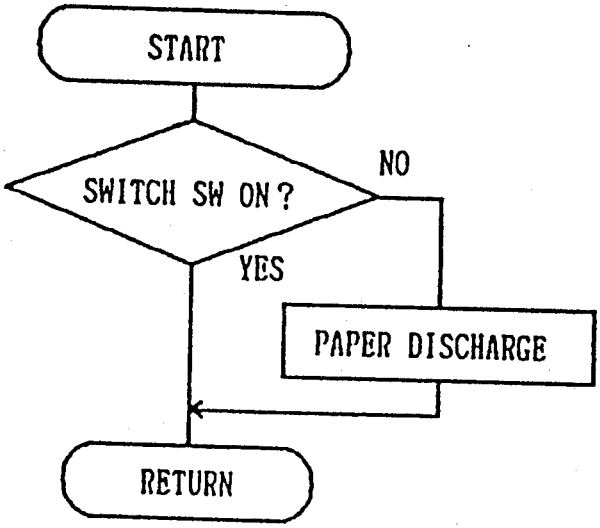
FIG. 45 is a flow chart showing an action of the control circuit in a paper transport unit.

FIG. 42 shows a control circuit of each image forming unit 1, and FIG. 43 a control circuit of each paper transport unit 2. In FIG. 42, print engine PE includes a charger 9, a main motor for driving the photoconductor 8 and paper feed roller 14, and the like. Output signals from a switch SW are inputted into the print engine PE and a microcomputer MC which controls the laser head 4. In FIG. 43, output signals from the switch 43 are inputted into logical circuit LC, and the logical circuit LC actuate the solenoid which drives the changeover claw 23 basing on the signals from the switch SW. FIG. 44 shows a flow chart of subroutine in the control program of the microcomputer MC of the image forming unit 1, and FIG. 45 is a flow chart showing an action of the logical circuit LC of the paper transport unit 2. In the image forming unit 1, printing action is immediately stopped when the switch SW is turned off. In the paper transport unit 2, the changeover claw 23 is operated when the switch SW is turned off, and the sheets thereafter fed are all discharged onto the discharge tray 25.

Figure 46:
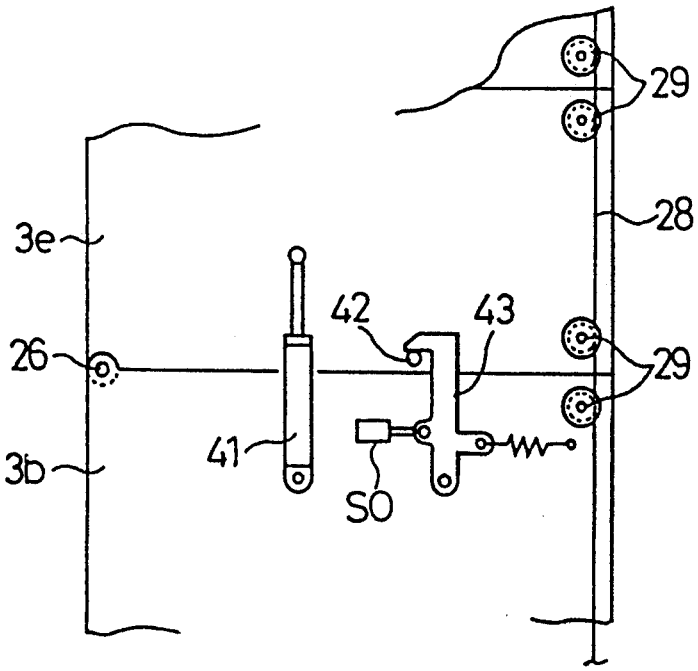
FIG. 46 is a structural view of a support means showing another example when the lock means shown in FIG. 10 in the first embodiment is arranged to be driven by a solenoid.
Figure 47:
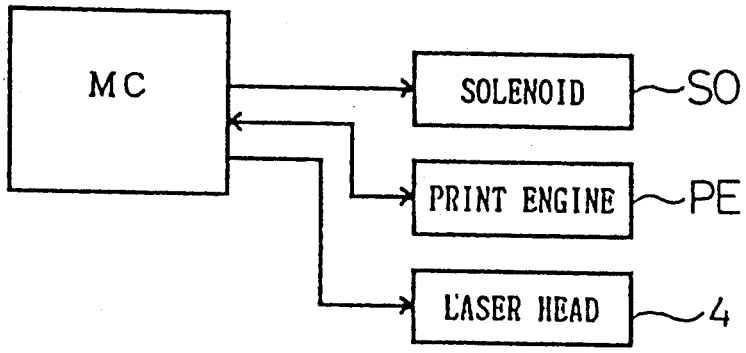
FIG. 47 shows a control circuit when a solenoid is utilized.
Figure 48:
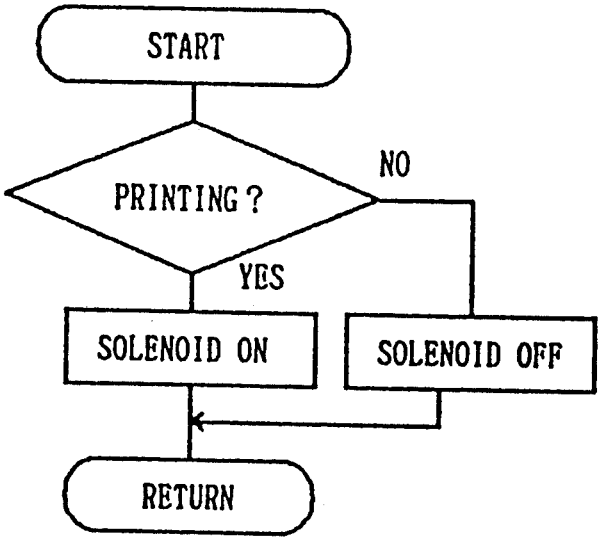
FIG. 48 is a flow chart showing a subroutine of a control program in a control circuit.

As illustrated in FIG. 46, it may also be arranged to actuate the lock mechanism described in FIG. 10 by a solenoid SO to prohibit the movement of the upper unit when printing operation is being performed. FIG. 47 is a drawing showing a control circuit of each image forming unit, and FIG. 48 shows a subroutine of a control program in the microcomputer MC. More particularly, when a printing operation is being performed, movement of the upper unit is prohibited by actuating the solenoid SO, while when printing operation is not being performed, lock is released by turning off the solenoid.

A second embodiment of the present invention will now be described hereinafter with reference to FIGS. 11 through 16.

Figure 15:
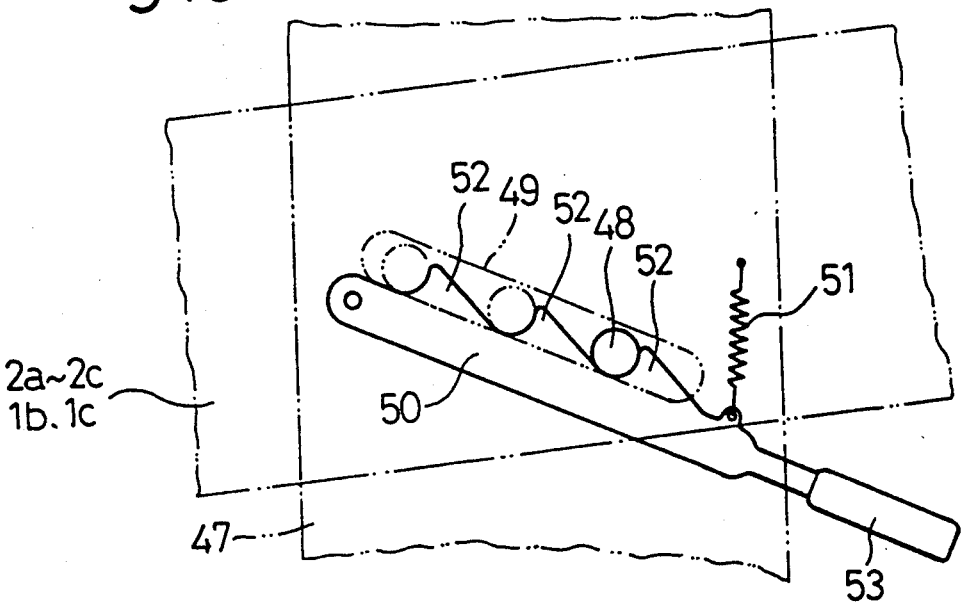
FIG. 15 is a front view showing a mechanism which holds each unit capable of releasing unit from a pivotally retracted condition.
Figure 16:
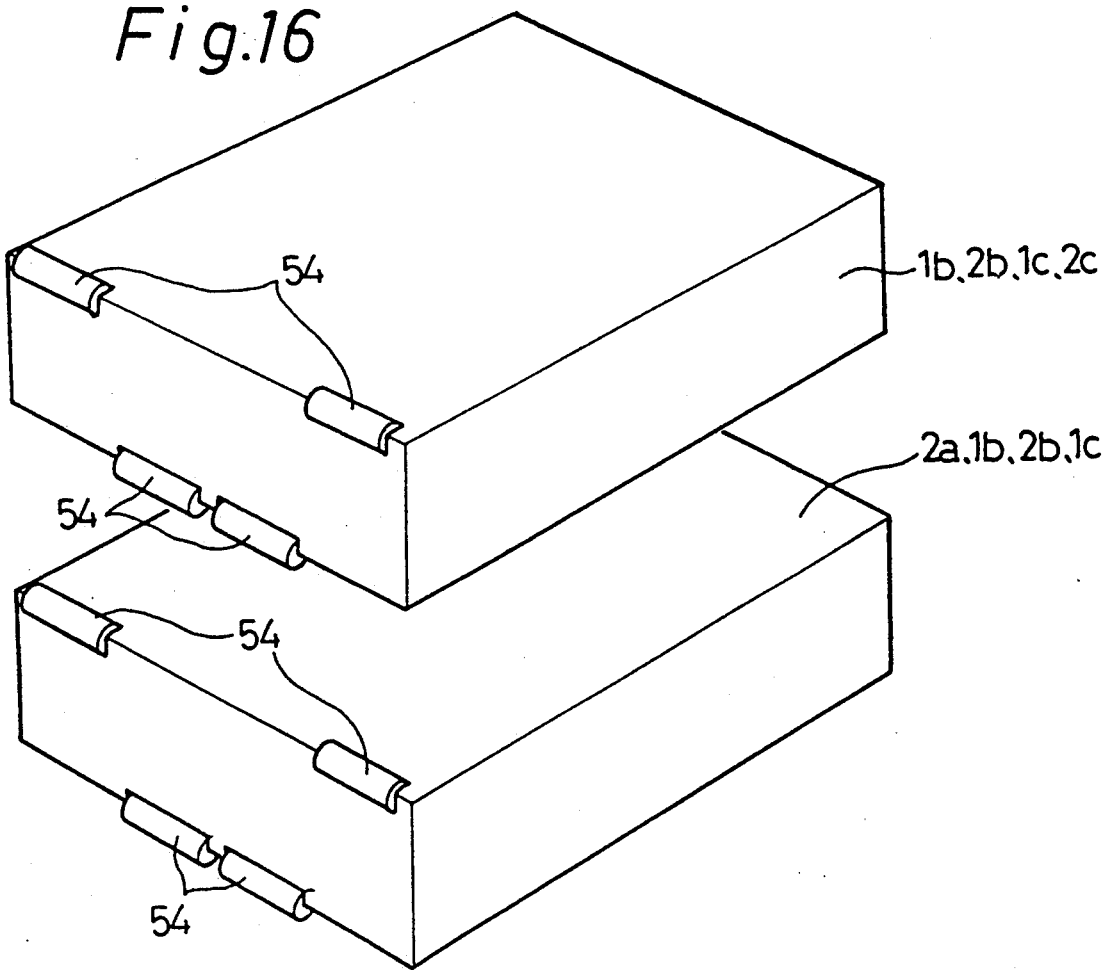
FIG. 16 is a perspective view showing structures of end portions of each unit.
Figure 17:
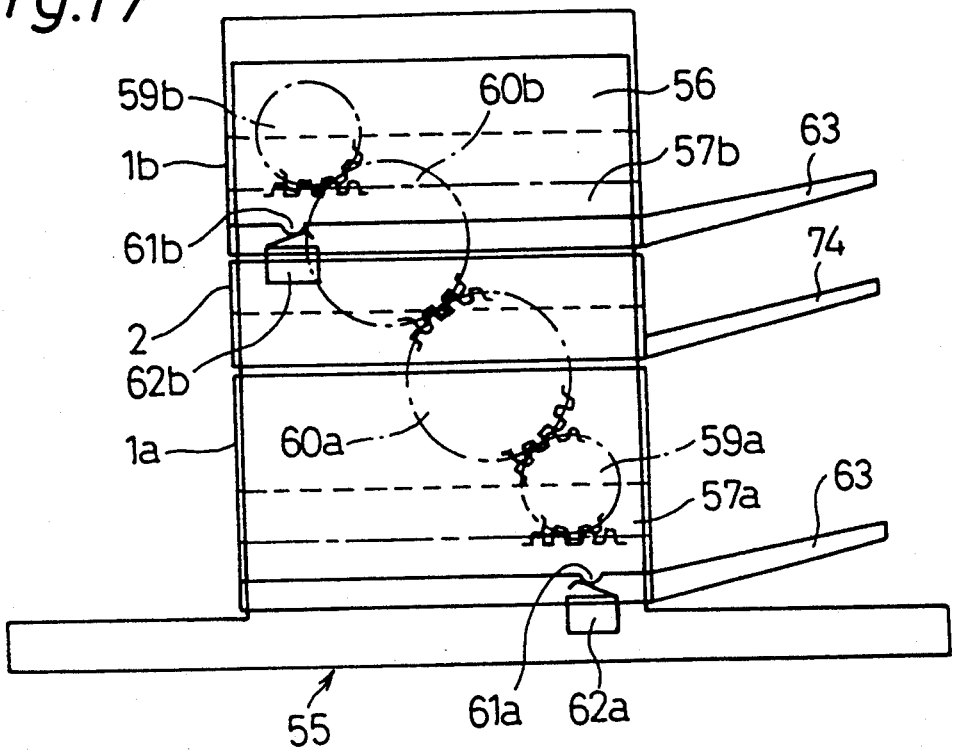
FIG. 17 is the whole front view showing an image forming apparatus in a third embodiment of the present invention.
Figure 18:
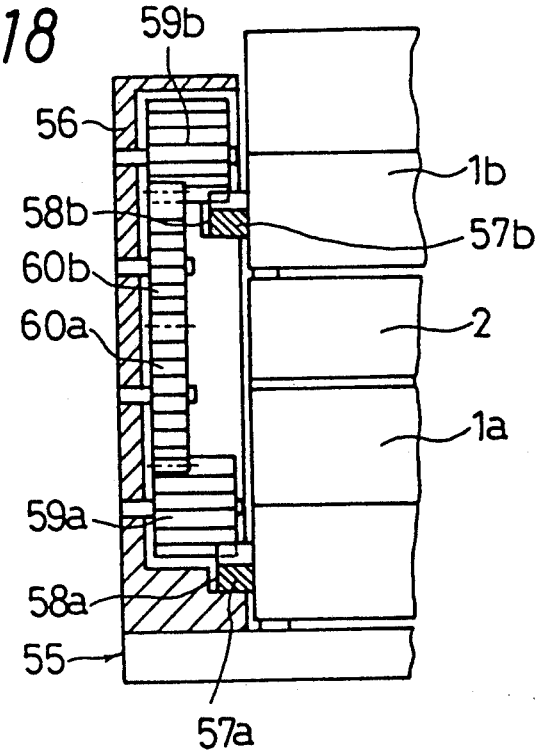
FIG. 18 is a longitudinal side view showing a retracting movement mechanism of each unit.
Figure 19:
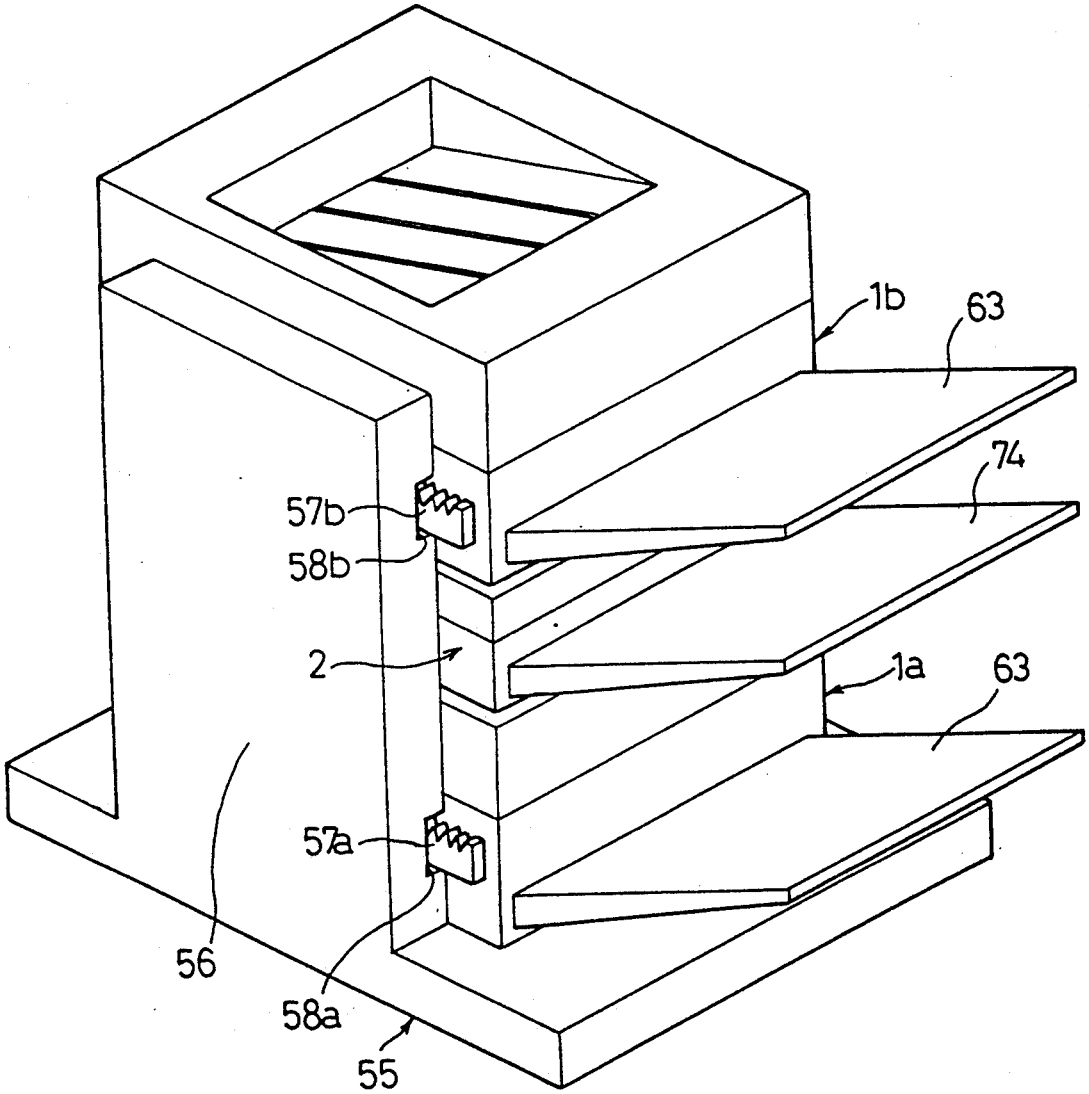
FIG. 19 is the whole perspective view showing an image forming apparatus.
Figure 20:
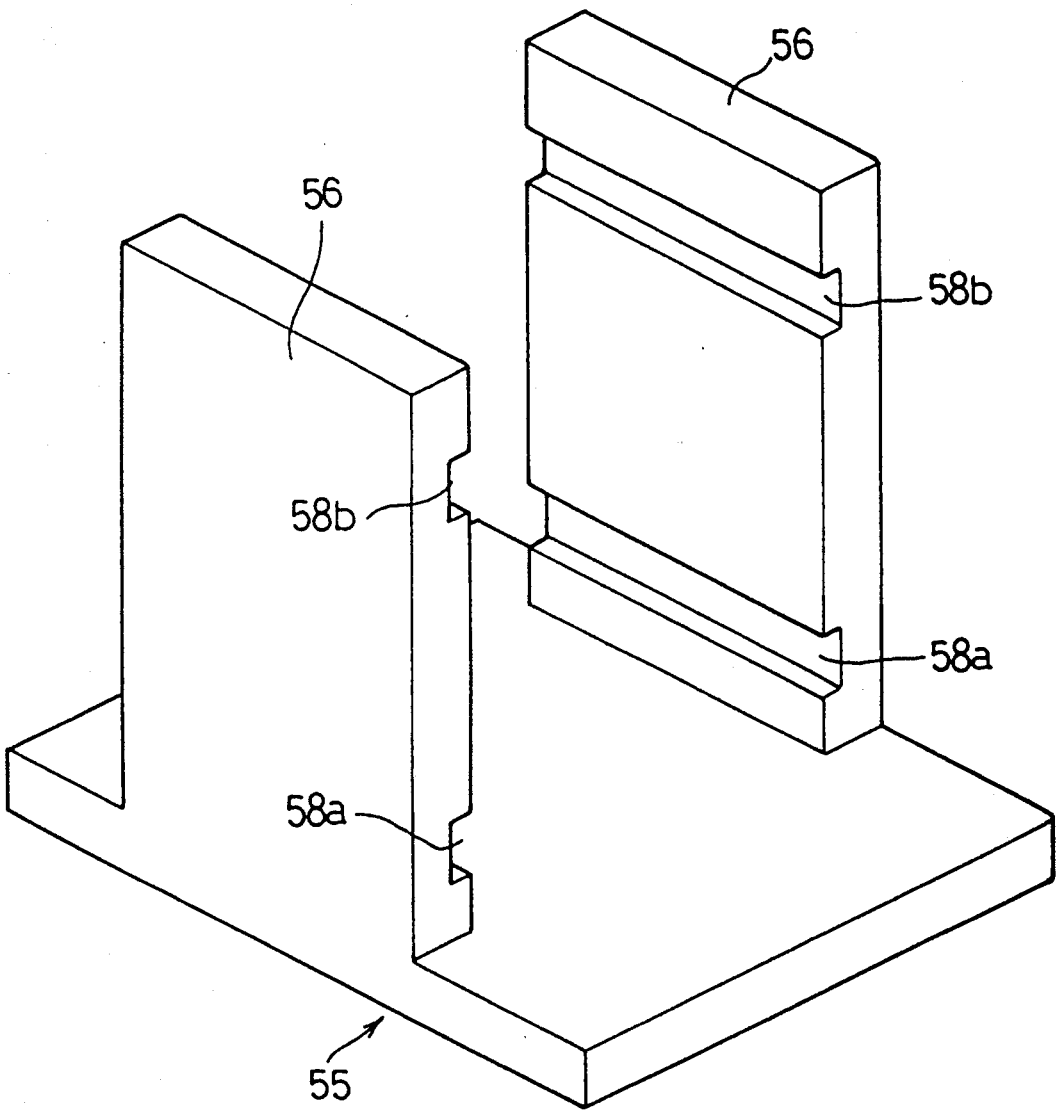
FIG. 20 is a perspective view showing a support frame of each unit.

A support unit 46 in this embodiment is provided with guide support plates 47 erected on both sides of each image forming unit 1a–1c and each paper transport unit 2a–2c vertically stacked. In the guide support plates 47, inclined guide grooves 49 are formed to engage with engaging shafts 48 projected on one end of both sides of each unit, from a paper transport unit 2a at the second stage to upper units. Between each unit and the guide support plate 47, a stop lever 50 is movably vertically mounted along the lower edge of the inclined guide groove 49 and is energized upward with a spring 51 as shown in FIG. 15. At the upper edge of the stop lever 50, a plurality of engaging protrusions 52 for obstructing the downward movement of the stop lever are spaced apart, and at one end thereof, there is provided a releasing operation section 53. As shown in FIG. 16, at the upper and lower edges of the other end of each unit 1*b*–1*c* and 2*a*–2*c*, there are provided rollers 54 at the positions where each roller does not interfere with each other to have the upper or lower surface of each unit are relatively slid smoothly relative to each other.

Figure 12:
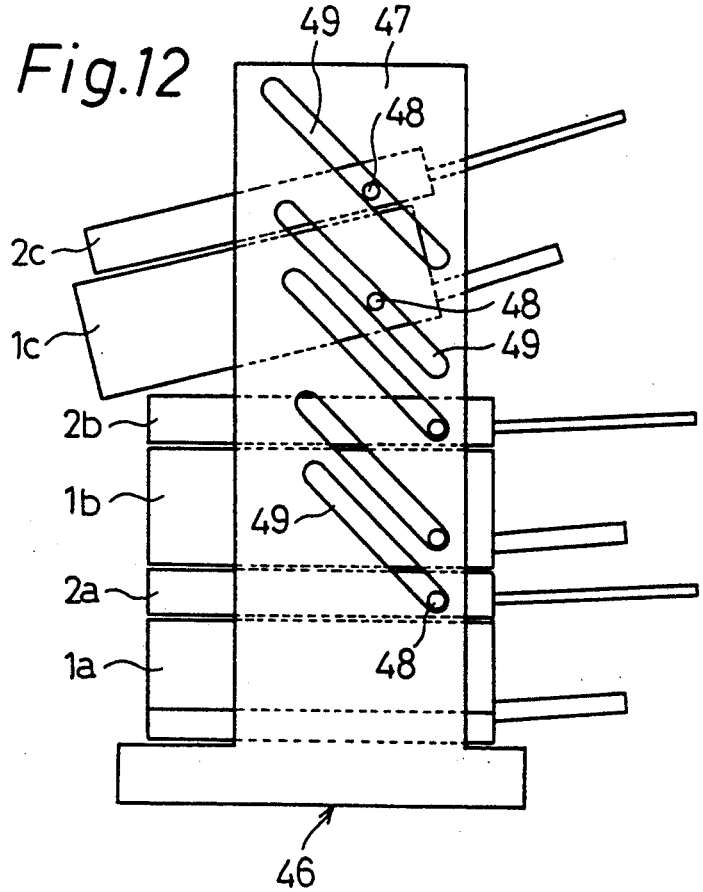
FIGS. 12 through 14 are front views showing image forming apparatuses wherein upper units stacked above certain units at different stages are pivotally retracted.

According to the above construction, as illustrated in FIG. 12, when one end of the upper image forming unit 1*c*, for instance, is lifted upward, the upper image forming unit 1*c* and the upper paper transport unit 2*c* are inclined upward, and the engaging shafts 48 come in engagement with the engaging protrusions 52 of the stop lever 50 to maintain the inclined position. Since the other end of the unit is held by the rollers 54 when the unit is inclined, the units are relatively smoothly moved. The space above the middle paper transport unit 2*b* is thus opened for a desired jam clearing and maintenance operations.

Figure 13:
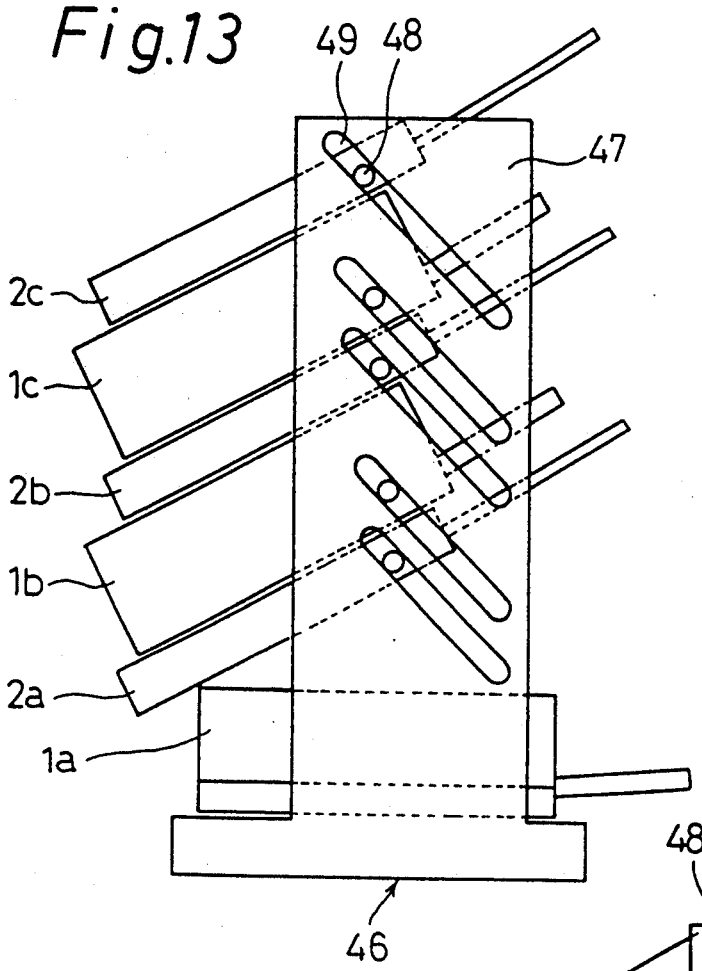
Figure 14:
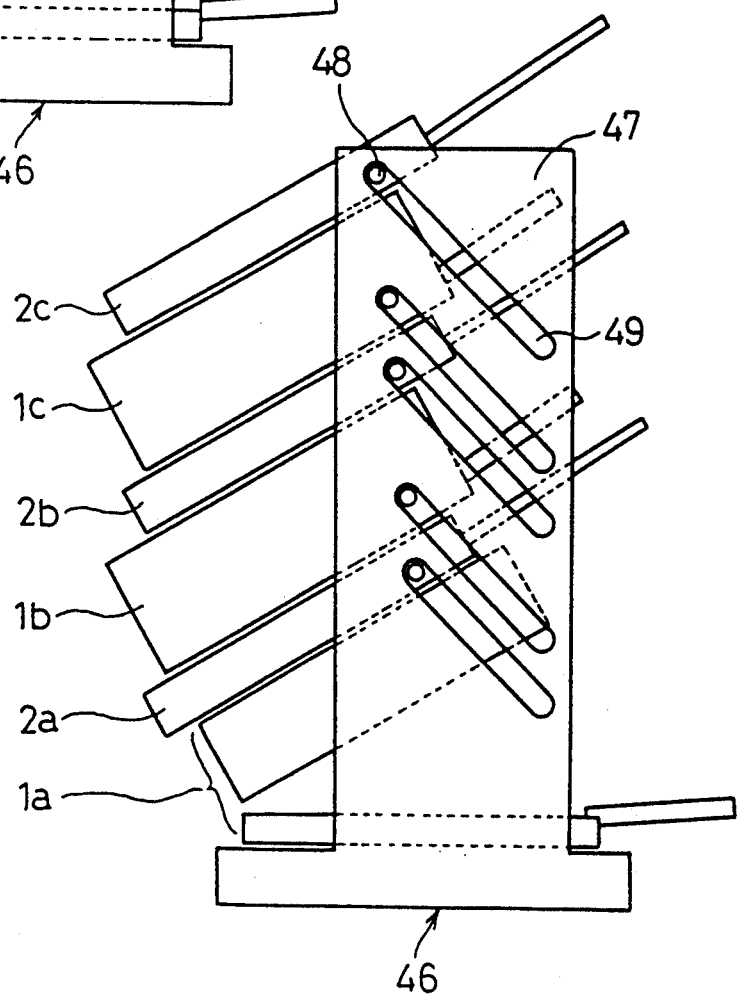

FIG. 13 shows a state when the upper space of the image forming unit la positioned at lower stage is opened under which the upper frame of the image forming unit 1*a* is opened for conducting a maintenance operation as shown in FIG. 14. After the completion of the maintenance operation, the unit lifted upward can be returned to the original position by pressing down the releasing operation section 53. Since the engaging shaft 48 of each unit is engaged with the inclined guide groove 49 at this stage, the paper transport path of each unit is accurately positioned at the position it is to be connected.

Description will now be made on a third embodiment of the present invention referring to FIGS. 17 through 25. In this embodiment, a paper transport unit 2 is provided on an image forming unit la positioned at lower stage as shown in FIGS. 17 through 20, and an upper image forming unit 1*b* is provided above the paper transport unit 2. On both sides of these units, there are erected support frames 56 opposite to each other on a support unit 55. At the lower portions on both sides of the lower image forming unit 1*a* and the upper image forming unit 1*b*, racks 57*a* and 57*b* are fixed respectively, and the racks 57*a* and 57*b* are slidably fitted into sliding grooves 58*a*, 58*b* formed on the support frames 56. In the support frame 56, there are provided a pinion 59*a* which engages with one end of the rack 57*a*, a pinion 59*b* which engaged with another end of the rack 57*b* and a pair of gears 60*a*, 60*b* rotatably arranged to interlock with the pinions 59*a*, 59*b*. Protrusions 61*a*, 61*b* are provided at the lower portions of one end of the rack 57*a* and of the other end of the rack 57*b*. Further, safety switches 62*a*, 62*b* such as microswitch for detecting regular positions of unit 1*a*, 1*b*, 2 are disposed.

Figure 21:
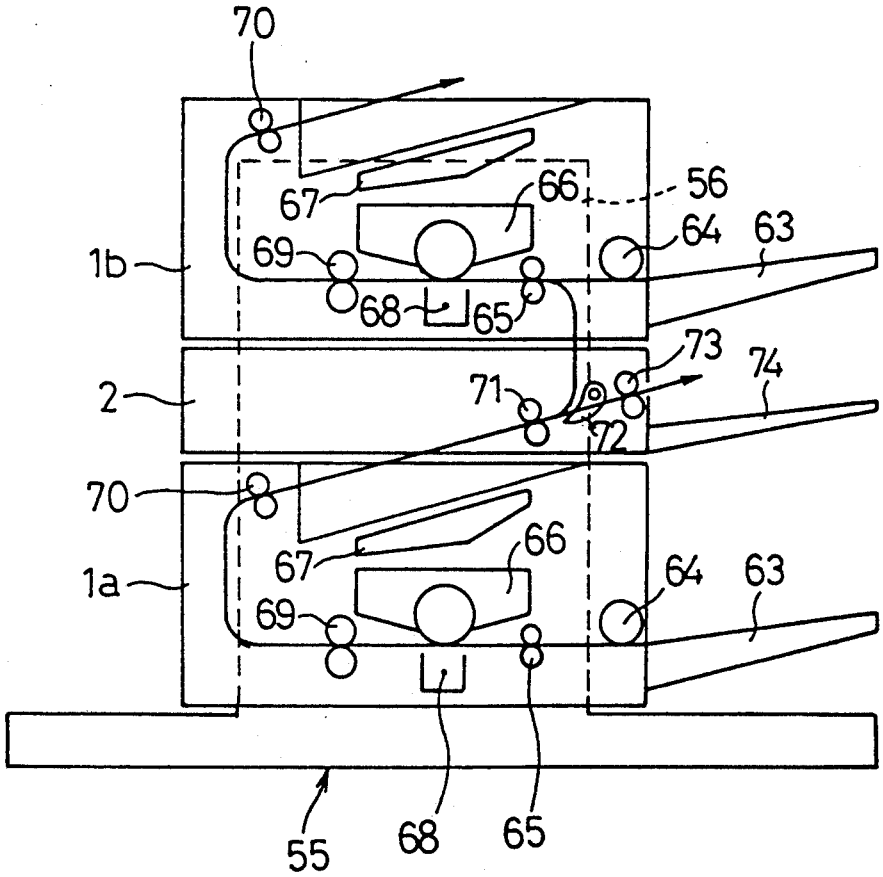
FIG. 21 is a schematic structural view showing an image forming unit and sheet transport unit.

Description will now be made on the construction of the image forming units 1*a*, 1*b* and the paper transport unit 2 in the present embodiment referring to FIG. 21.

Figure 22:
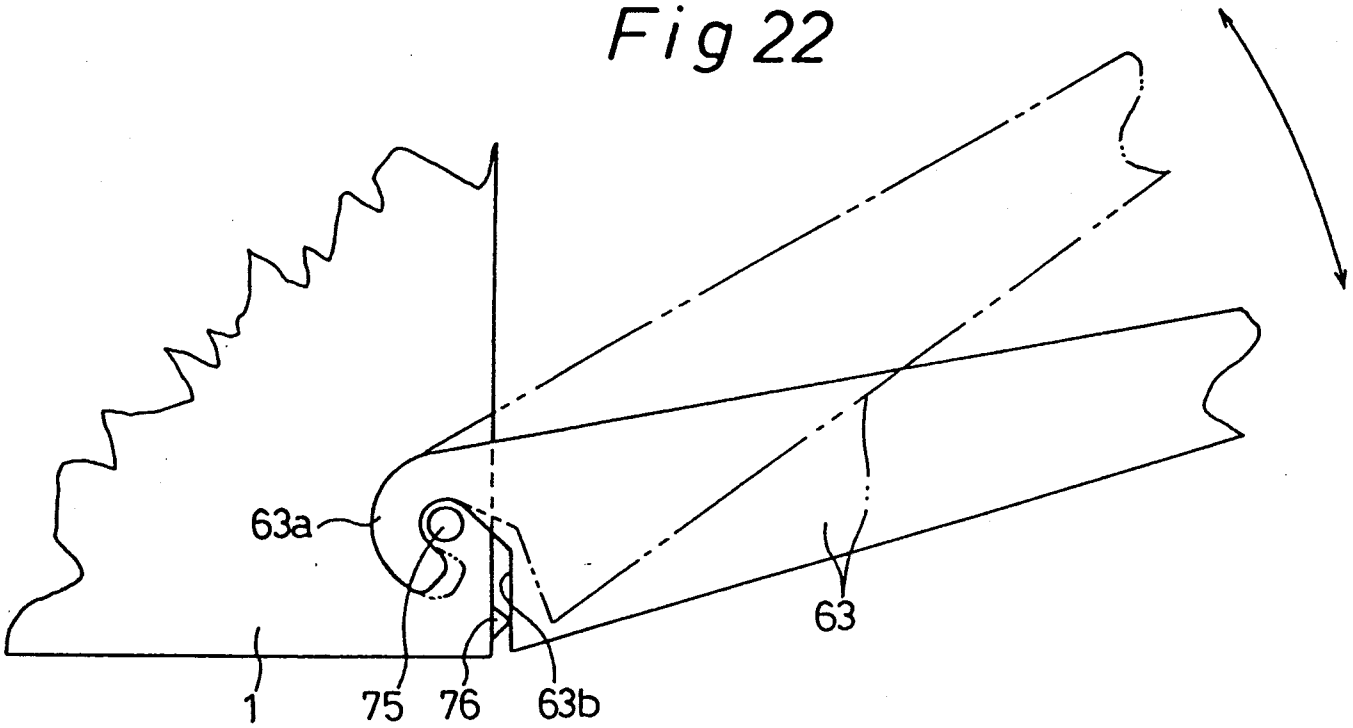
FIG. 22 is a front view showing a detachable structure of a paper tray.

The construction is substantially the same as that of the one in the first embodiment of the present invention. In the image forming unit 1 (1*a*, 1*b*), there are provided paper feed trays 63, paper feed rollers 64, register rollers 65, image forming cartridges 66 which incorporate such devices as photoconductive drum, developing unit, cleaner and charger, exposure apparatuses 67 which incorporate laser beam source and optical system, transfer means 68, fixing devices 69, and discharge rollers 70 for discharging sheets on which images are transferred upward along inclined surfaces. The paper transport unit 2 is provided with a transport roller 71 for receiving and conveying a sheet discharged from the image forming unit 1*a* positioned at the lower stage, a changeover claw 72 for changing over whether to forward a sheet to the image forming unit 1*b* positioned at the upper stage or to discharge it, a discharge roller 73 and a discharge tray 74. In the paper feed tray 63, a hook portion 63*a* at the leading end of the tray is hooked to a shaft 75 provided in the main body of the unit as illustrated in FIG. 22, and the tray is pivotally and disengageably mounted by bringing a holding surface 63 provided under the hook portion 63*a* in contact with a hitting member 76.

Figure 23:
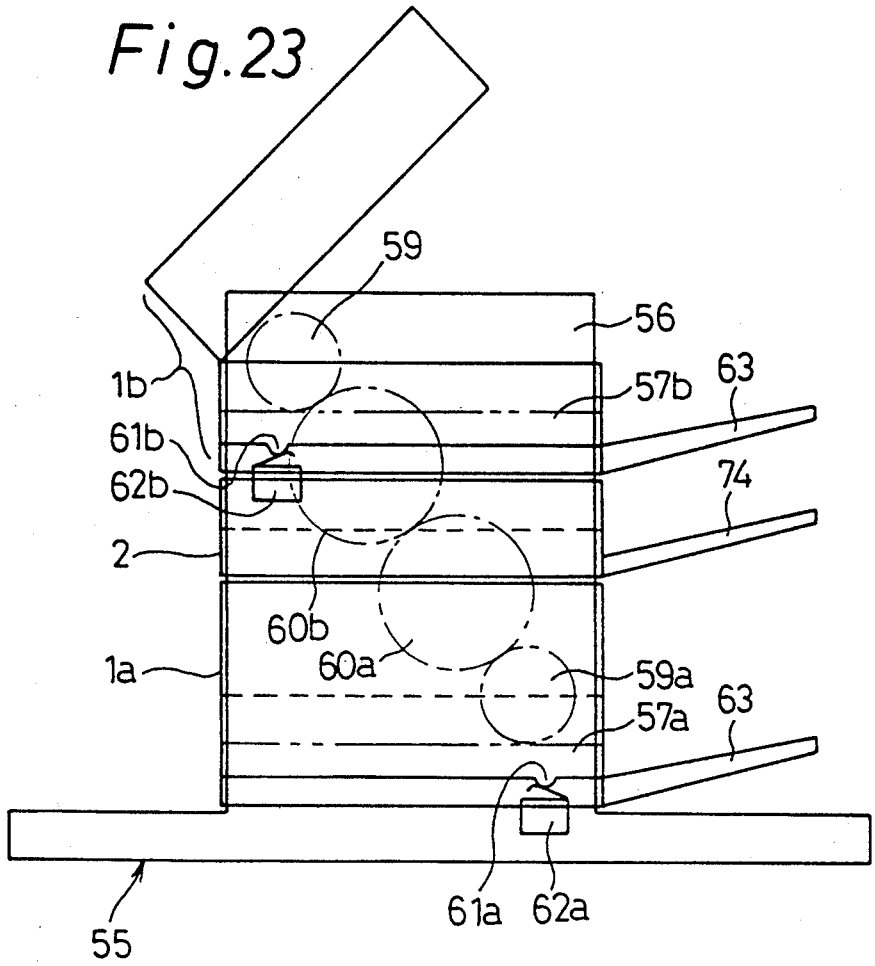
FIGS. 23 through 25 are the whole front views showing various conditions when each unit is retracted.

With the construction as described above, an operation for clearing jam and maintenance of the image forming unit 1*b* positioned at the upper stage can be performed by opening the upper frame of the image forming unit 1*b* since there is no obstacle as shown in FIG. 23.

Figure 24:
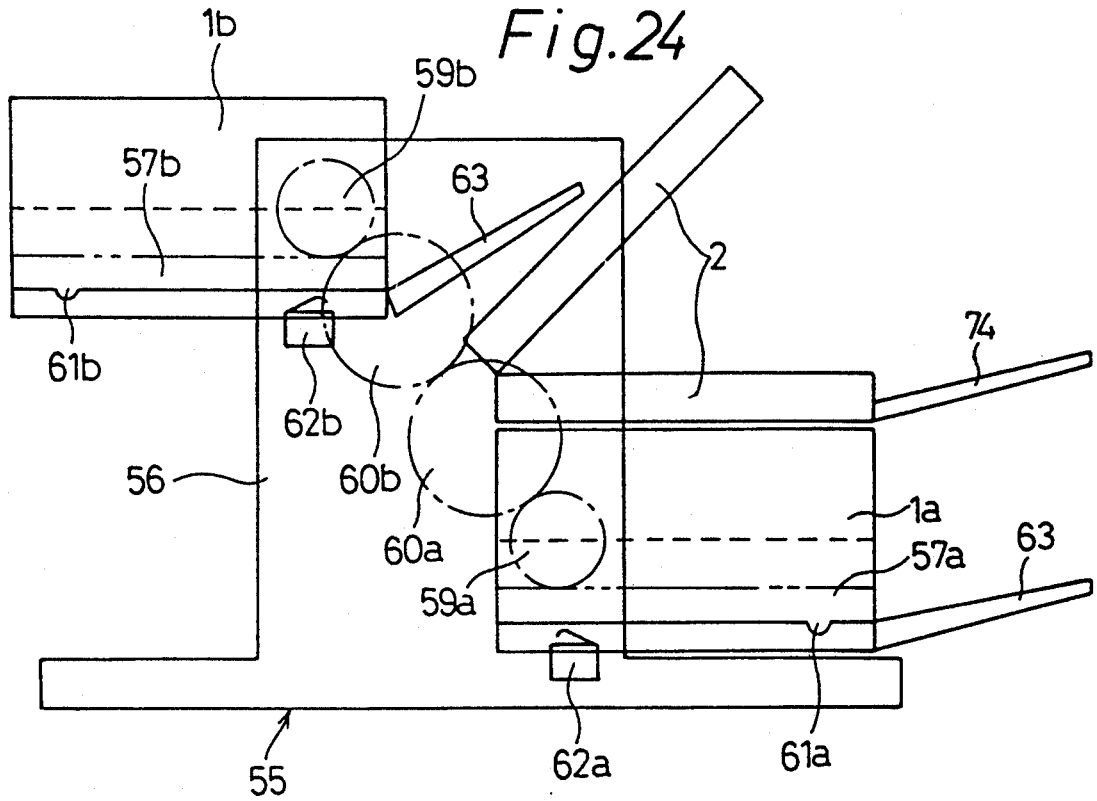

When a maintenance operation is conducted for the paper transport unit 2, the image forming unit 1*a* at the lower stage and the paper transport unit 2 are pulled out together to move them to one side as illustrated in FIG. 24. With this movement, the image forming unit 1*b* at the upper stage is moved to the other side and it is retracted from the upper surface of the paper transport unit 2 leaving no obstacle thus enabling to conduct an operation by opening the upper frame. At this stage, the upper frame of the paper transport unit 2 and the paper feed tray 63 of the image forming unit 1*b* at the upper stage interfere with each other, however, it does not interfere the operation since the paper feed tray 63 can be retracted upward. Since the lower and upper image forming units 1*a*, 1*b* are relatively moved and retracted in the opposite directions, the amount of movement is less and the unit can be balanced well. When they are returned to their regular positions after completion of the operation, the safety switches 62*a* and 62*b* are turned on to be ready for image forming operations.

Figure 25:
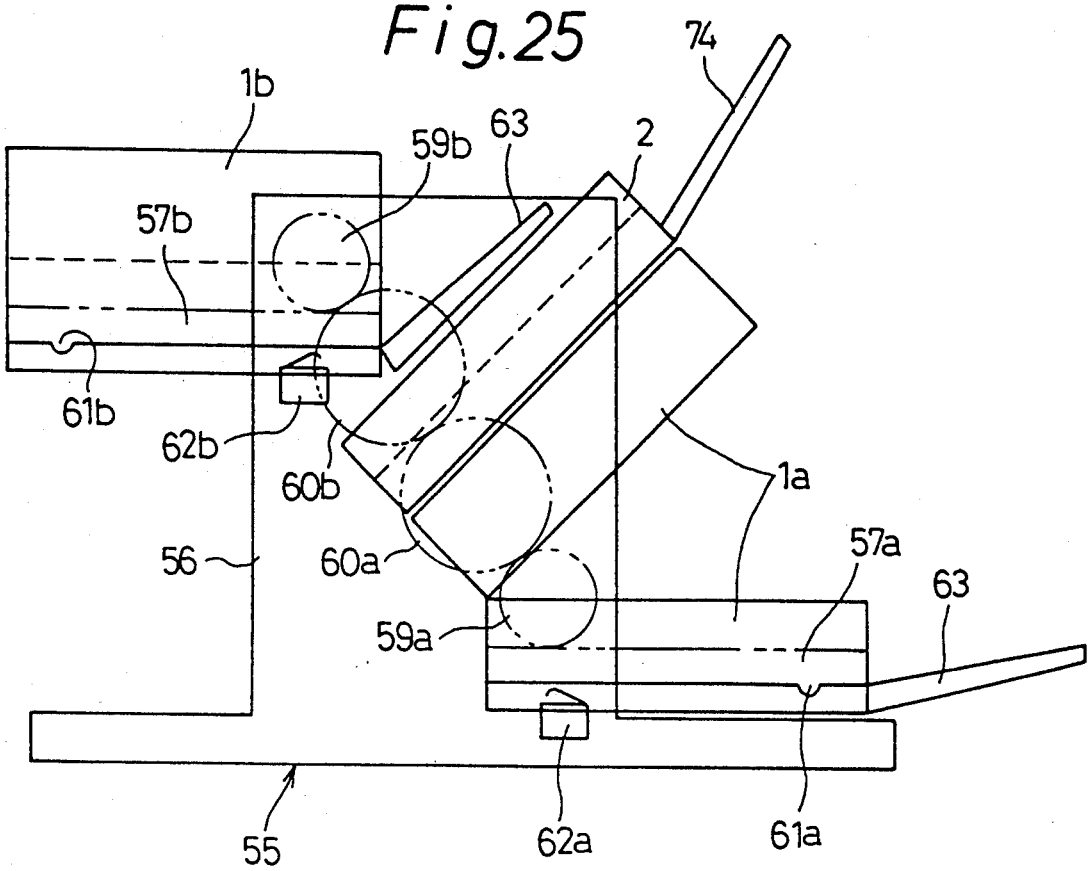

When a maintenance operation is conducted for the image forming unit 1*a* at the lower stage, the image forming units 1*a*, 1*b* are moved and retracted just like the case of the maintenance operation of the paper transport unit 2 as illustrated in FIG. 25, and under the state, the upper frame of the image forming unit at the lower stage is opened upward together with the paper transport unit 2 thus enabling to conduct a maintenance operation of the image forming unit 1*a*.

A fourth embodiment of the present invention will now be described with reference to FIGS. 26 through 31.

Figure 26:
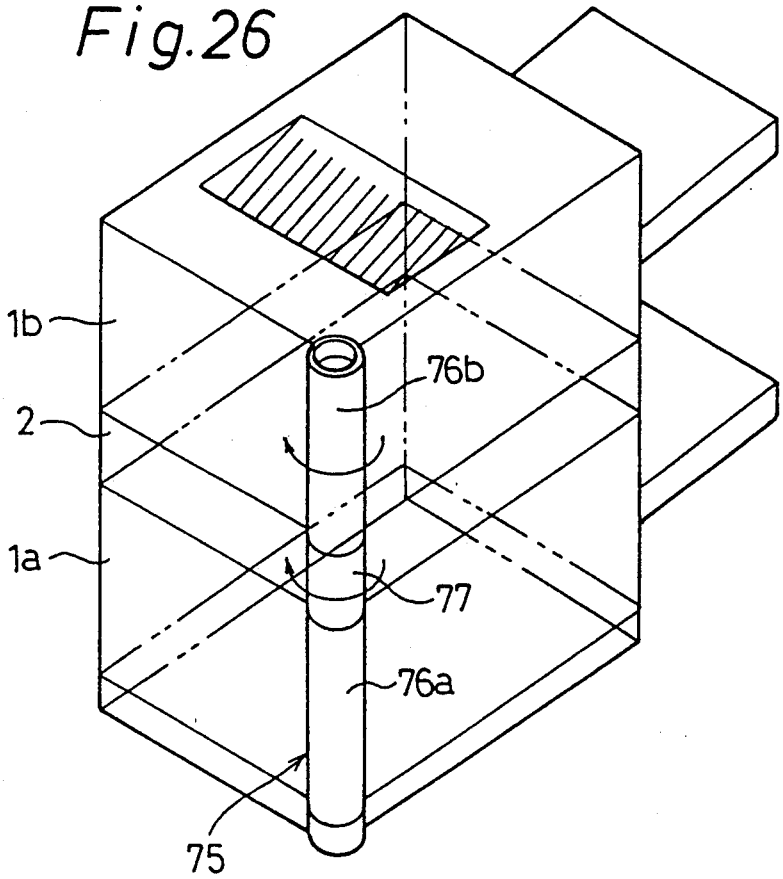
FIG. 26 is the whole perspective view showing an image forming apparatus in a fourth embodiment of the present invention.
Figure 27:
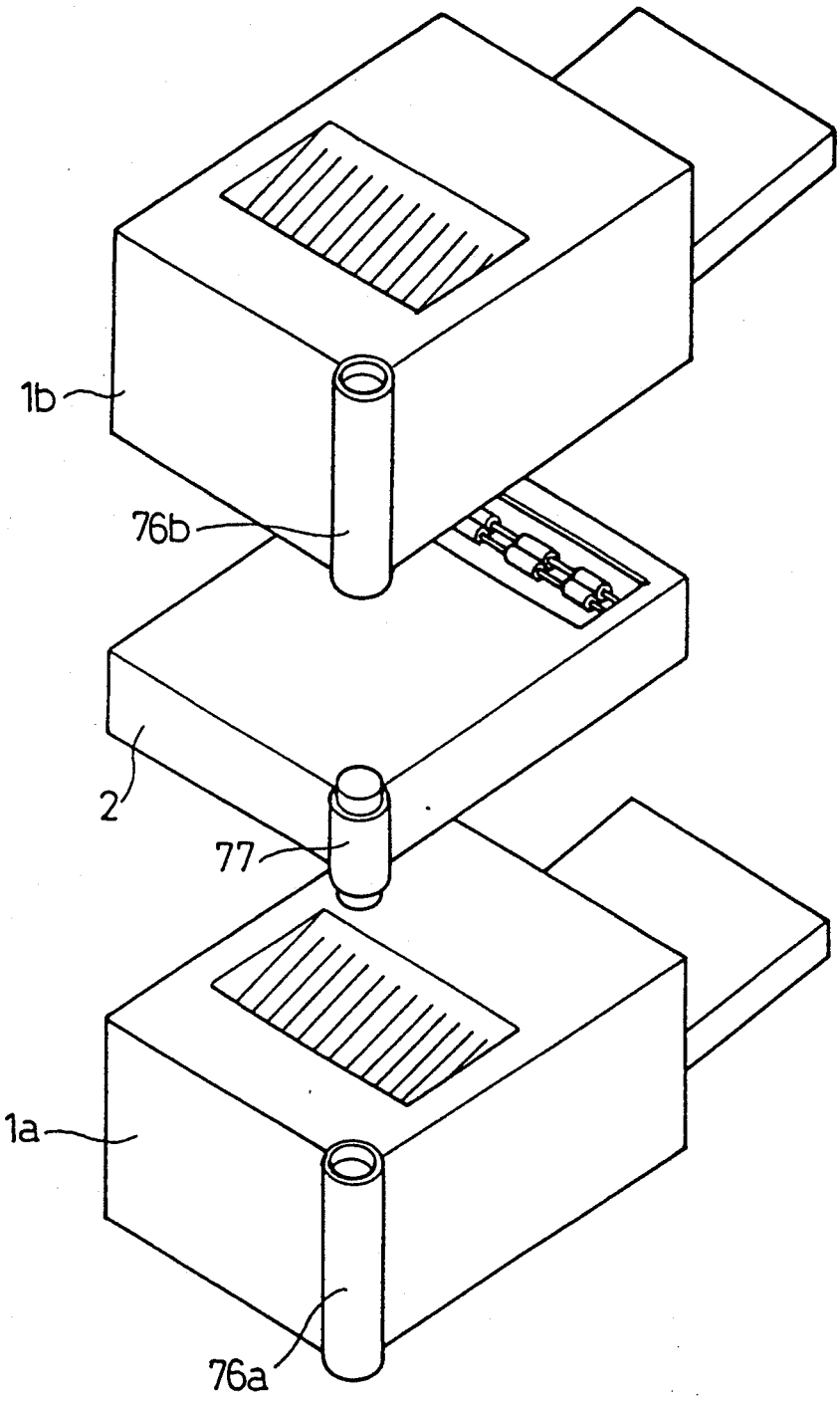
FIG. 27 is a perspective view showing a state when the entire apparatus is dismantled into each unit.

In this embodiment, an image forming unit 1*a* at the lower stage, a paper transport unit 2 and an image forming unit 1*b* at the upper stage are stacked like the third embodiment of the present invention. As shown in FIGS. 26 and 27, they are pivotally retractably supported in the horizontal direction by a rotation support means disposed at an angle section. The rotation support means 75 is composed of pivot sections 76*a*, 76*b*, 77 provided at one angle section of each unit 1*a*, 2 and 1*b* and they can be mutually connected and fitted.

Figure 28:
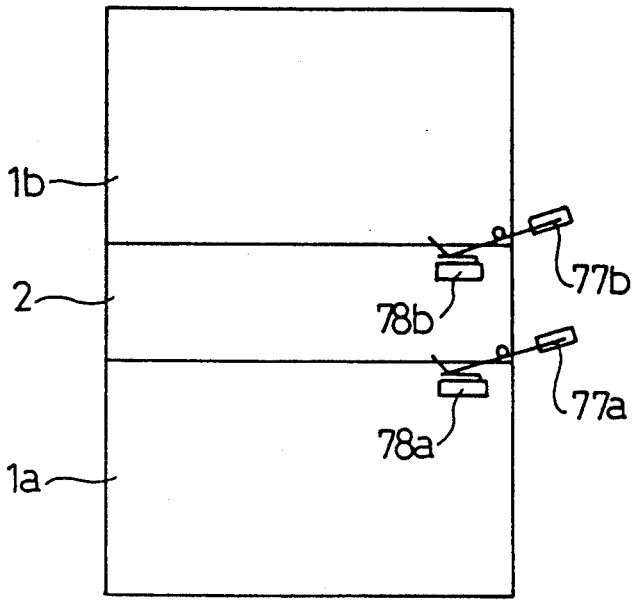
FIG. 28 is a structural view showing how each unit is connected and locked.

As shown in FIG. 28, lock means 77*a* and 77*b* are provided in the upper units 2 and 1*b* for engaging with the units 1*a* and 2 which are positioned at the lower positions when the units 1*a*, 2 and 1*b* are stacked at regular positions. Safety switches 78*a* and 78*b* are disposed in the lower units 1*a* and 2 for detecting the lock means 77*a* and 77*b* under the state as described.

Figure 29:
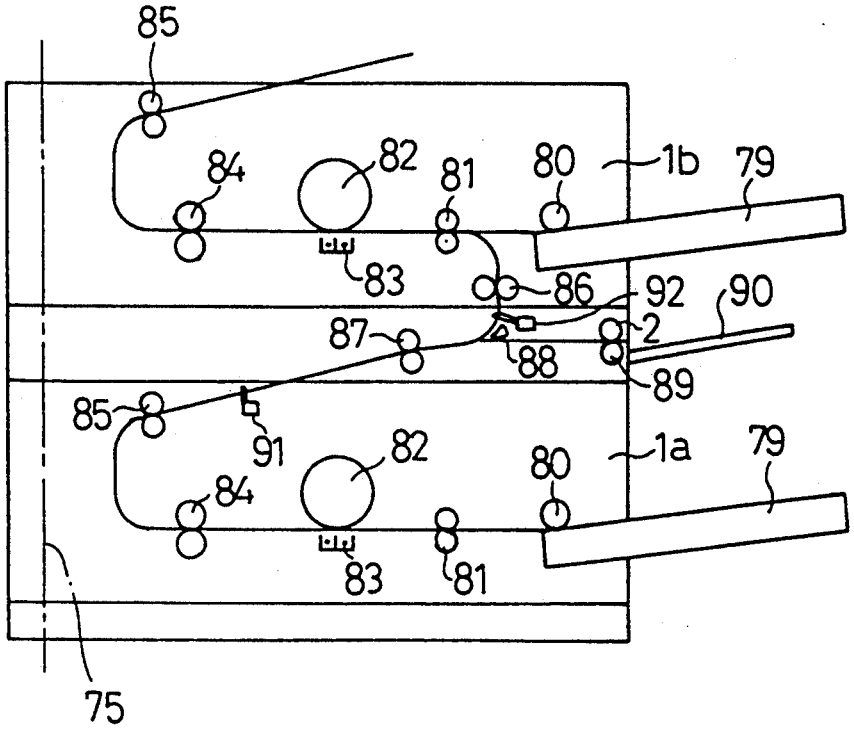
FIG. 29 is a schematic structural view showing an image forming unit and sheet transport unit.

Constructions of the image forming units 1*a*, 1*b* and paper transport unit 2 in the present embodiment will now be described referring to FIG. 29.

The constructions are substantially the same as that of the one described in the third embodiment of the present invention, however, in the image forming unit 1 (1*a*, 1*b*), there are provided paper feed cartridges 79, paper feed rollers 80, register rollers 81, photoconductive drums 82, unillustrated developing devices, cleaners, image forming means such as charging means, exposure means, transfer means 83, fixing devices 84, and discharge rollers 85 for discharging a sheet on which an image is formed in the upward inclined direction. In the image forming unit 1*b* at the upper stage, there is provided a paper re-feed roller 86 for receiving a sheet sent out from the paper transport unit 2 and conveying it to the register roller 81 The paper transport unit 2 is provided with a transport roller 87 for receiving and transporting a sheet discharged from the image forming unit 1*a* at the lower stage, a changeover claw 88 whether to forward the sheet to the image forming unit 1*b* at the upper stage or to discharge it, a paper discharge roller 89 and a paper discharge tray 90.

Figure 30:
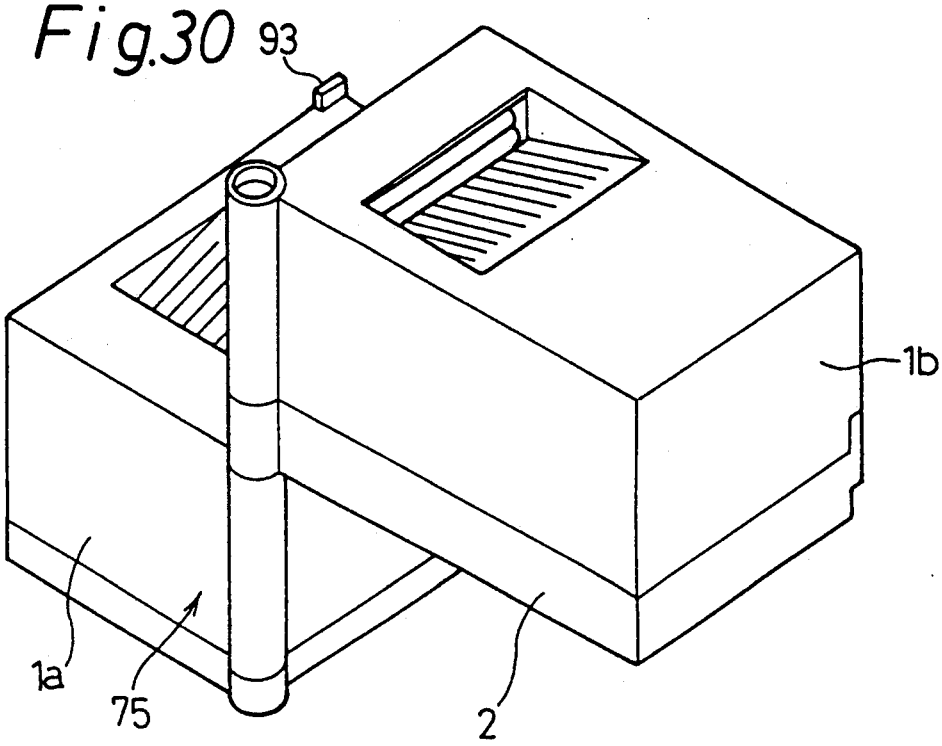
FIG. 30 is the whole perspective view showing a condition when a certain unit is pivotally retracted.
Figure 31:
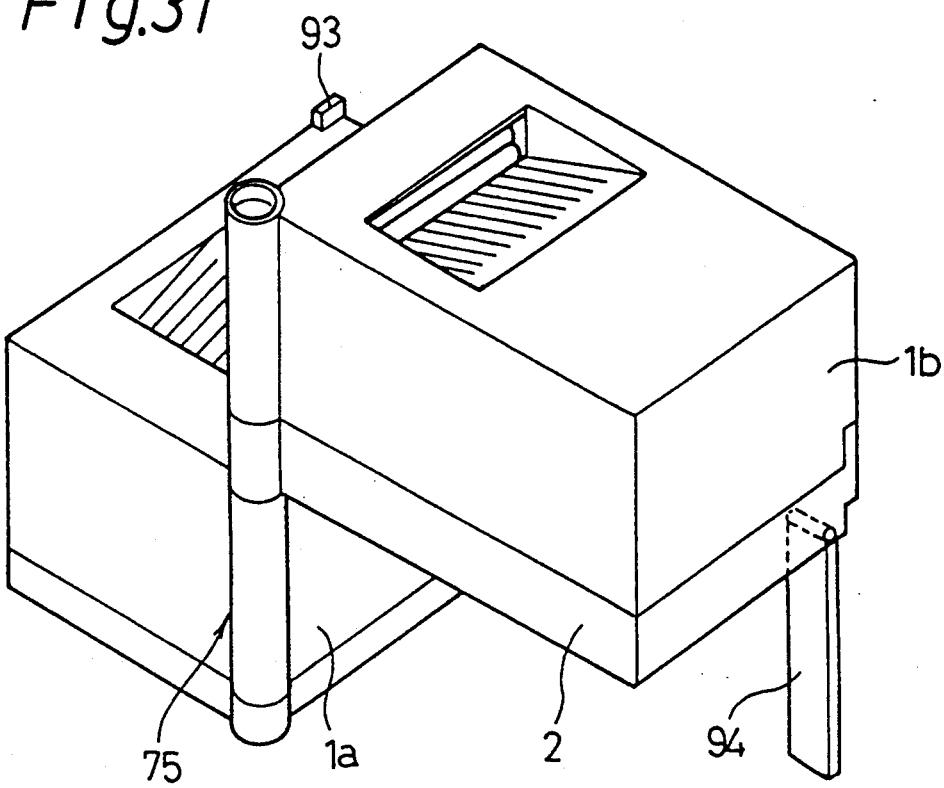
FIG. 31 is the whole perspective view showing another example of a pivotally retracted unit which is further devised.

Sensors 91 and 92 are also disposed at the positions where a sheet is sent out from the image forming unit 1*a* at the lower stage to the paper transport unit 2 and at the position where a sheet is sent out from the paper transport unit 2 to the image forming unit 1*b* at the upper stage for detecting whether a sheet is being sent or not. The transport roller 87 of the paper transport unit 2 is arranged to be automatically separable by a solenoid or the like, and when a sheet is detected by the sensors 91 and 92 at the time the lock means 77*a* and 77*b* are released, the transport roller 87 is separated so that the sheet is not damaged when the units 1*a*, 2 and 1*b* are revolved relatively With the constructions as described above, when a maintenance operation is conducted for the image forming unit 1*a* at the lower stage or for the paper transport unit 2, the unit 2 or 1*b* positioned above the unit (1*a* in the figure) is pivotally retracted as illustrated in FIG. 30 so that there is no obstacle left above to facilitate the maintenance operation. It is preferable to provide a positioning protrusion 93 at a position diagonal to the pivot support means 75 as shown in the figure. It is also preferable to provide a leg 94 which automatically falls down to support the leading end of the paper transport unit 2 and the image forming unit 1*b* at the upper stage when they are revolved as shown in FIG. 31.

A fifth embodiment of the present invention will now be described referring to FIGS. 32 through 38.

In this embodiment, a plurality of image forming units and paper transport units stacked are considered as one image forming apparatus, and the apparatus is divided into the upper and lower portions at paper transport path in the image forming unit and in the paper transport unit with further arrangement to be separable into the upper and lower portions at a desired separating section.

Figure 32:
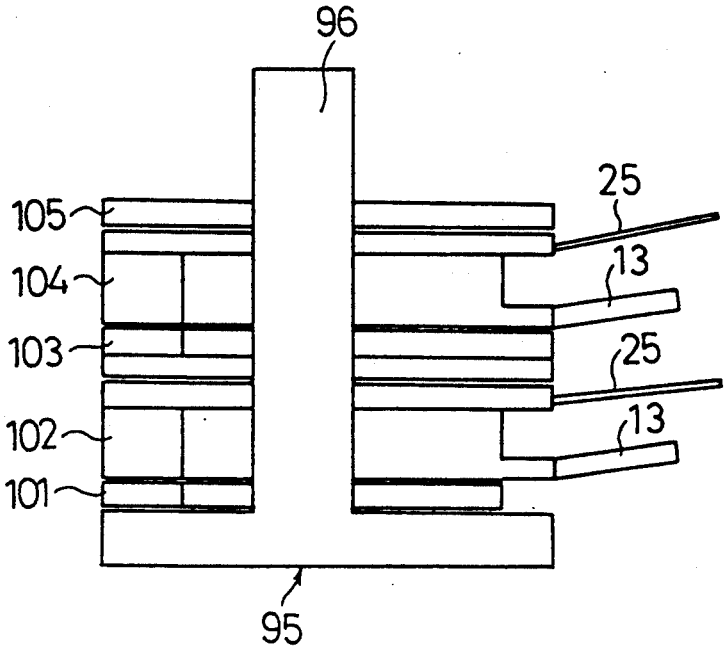
FIG. 32 is the whole front view showing an image forming apparatus in a fifth embodiment of the present invention.

More particularly, a reference numeral 95 in FIG. 32 designates a support unit, and elevating struts 96 are erected on both sides of the unit. Between the elevating struts 96, 96, there are stacked a lower transport unit 101 which constitutes the lower section of a paper feed path in a lower image forming unit, a lower unit 102 wherein a main body of a lower image forming unit is integrated with the lower portion of paper transport path in the paper transport unit, an intermediate transport unit 103 wherein upper portion of paper transport path in a lower paper transport unit is integrated with lower portion of a paper transport path in an upper image forming unit, an upper unit 104 wherein main body section of upper image forming unit is integrated with lower portion of paper transport path of an upper paper transport unit, and an upper transport unit 105 which constitutes an upper portion of paper transport path of upper paper transport unit.

Figure 34:
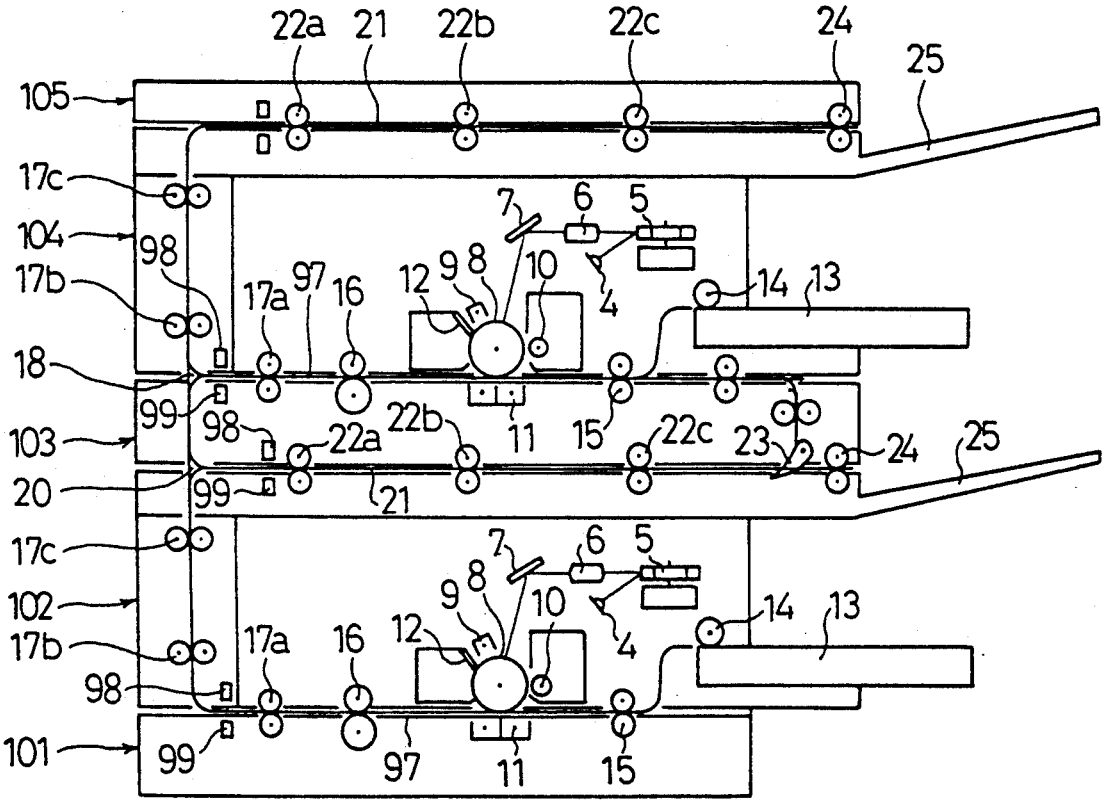
FIG. 34 is a schematic structural view showing each unit.

FIG. 34 shows how the image forming apparatus is stacked under the state described above. Since the basic construction as an image forming apparatus is substantially the same as that of the one described in FIG. 2, description on the same elements will be omitted by designating the same reference numerals. In this embodiment, a horizontal paper feed path 97 extending from a register roller 15 to a transport roller 17*a* in each image forming unit and a paper transport path 21 in each paper transport unit is made as a dividing section into the upper and lower portions, and sensors 98 and 99 are provided for detecting a state of engagement and disengagement of the connecting section at the paper feed path 97 and paper transport path 21.

Figure 35:
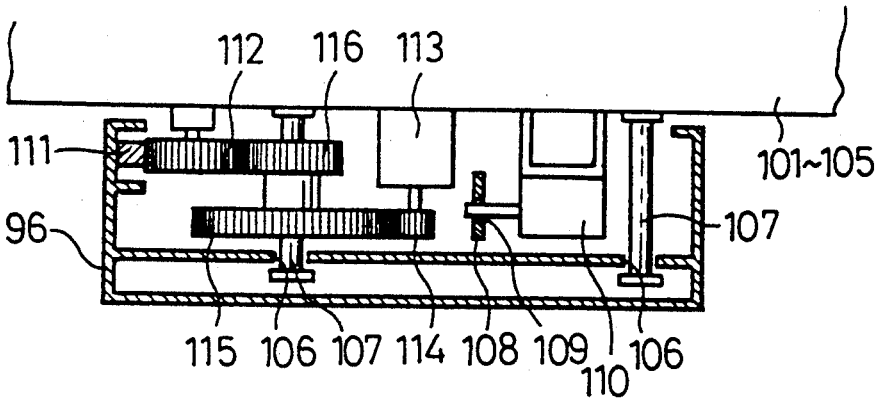
FIG. 35 is a front view showing an elevating mechanisms of each unit.
Figure 36:
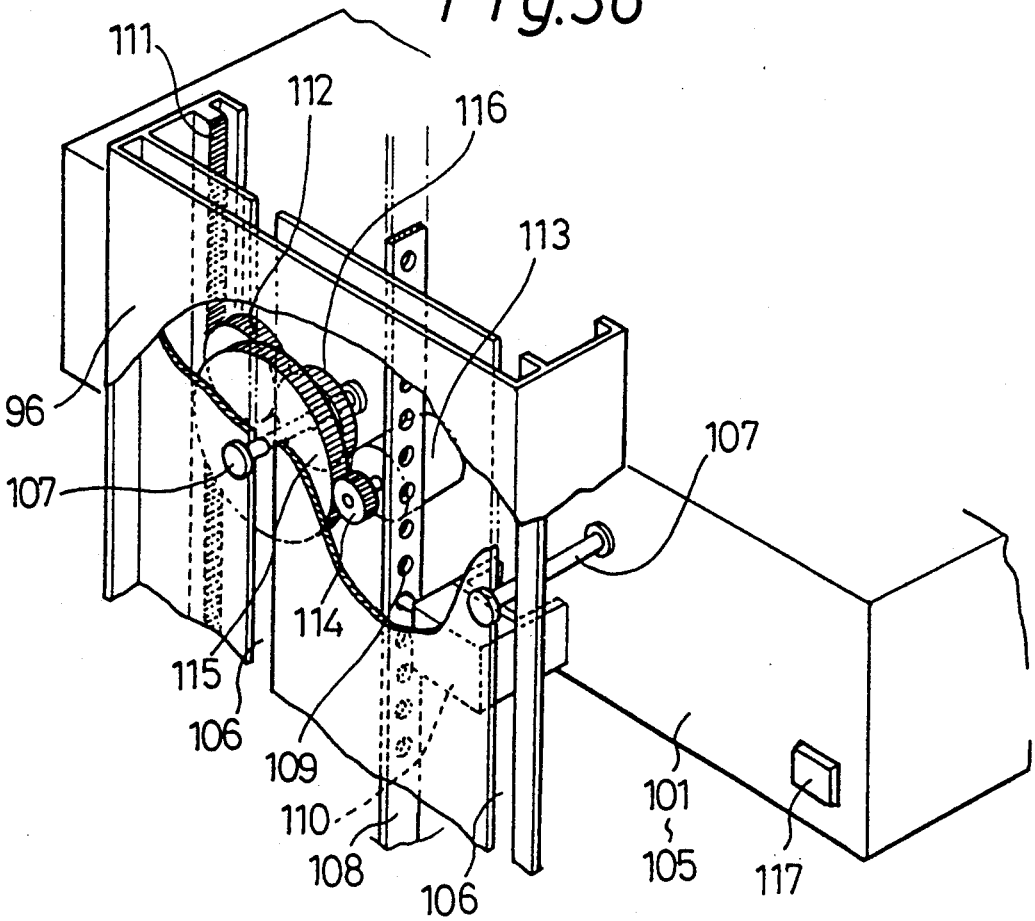
FIG. 36 is a perspective view showing an elevating mechanism.

Description will now be made on elevating mechanism of each unit 101–105 referring to FIGS. 35 and 36. With an arrangement guide shafts 107 protruded from the side of each unit 101–105 are engaged with a pair of guide grooves 106 provided in the elevating strut 96 and that positioning holes 109 spaced apart in the positioning member 108 vertically provided in the elevating strut 96 are engaged with a shaft of a solenoid 110 attached to the side of each unit 101–105, the units 101–105 are held at predetermined positions. In the elevating strut 96, a rack 111 is vertically disposed with a pinion 112 provided on the side of the units 101–105 to engage with the rack 111. The pinion 112 is driven by a driving motor 113 to vertically drive the units 101–105. The pinion 112 is driven through a driving gear 114 fixed to an output shaft of the driving motor and combined gears 115, 116 rotatably mounted on a guide shaft 107. On the side of the unit 101–105, there is also provided a switch 117 for operating the solenoid 110.

Figure 37:
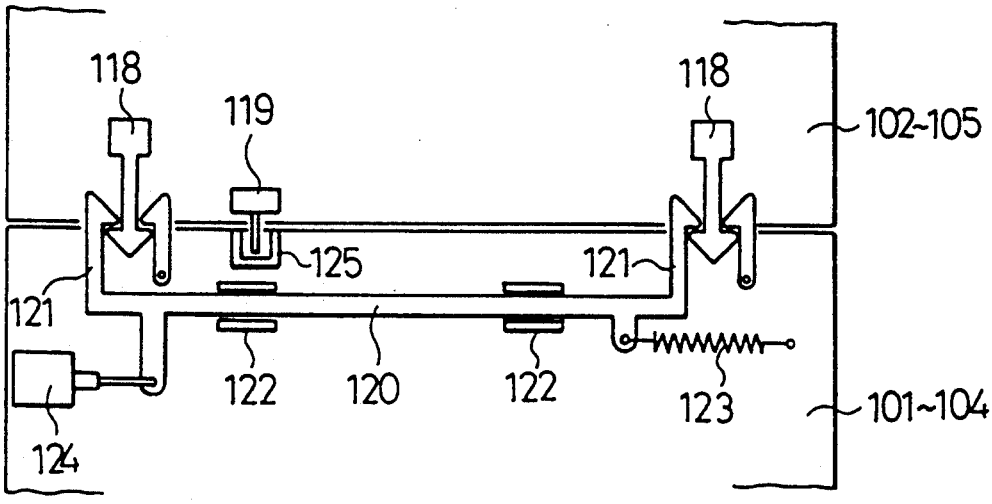
FIG. 37 is a structural view showing a means which locks each unit in a connected condition.
Figure 38:
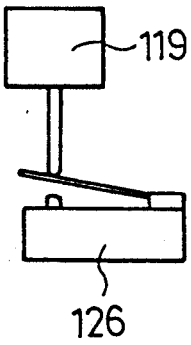
FIG. 38 is a front view showing a detecting means for detecting a connected condition of each unit.

As shown in FIG. 37, there is provided a lock mechanism in order to prevent the units vertically stacked from being disengaged accidentally. In the lock mechanism, there are provided a pair of engaging pieces 118 projecting downward from upper units 102–105 and a dog 119 for detecting a state of contact, and in the lower units 101–104, there are provided an engaging member 120 which is movable between an engaging position and an engagement releasing position relative to the engaging pieces 118. The engaging member 120 is movably held by guides 122, and on both ends thereof, there are provided engaging pieces 121 which are energized by a spring 123 to an engaging position, and is also movably arranged to an engagement releasing position by a solenoid 124. An optical sensor 125 is arranged for detecting the dog 119 when the units 101–105 are connected. As shown in FIG. 38, a microswitch 126 may be used in place of the optical sensor 125.

Figure 33:
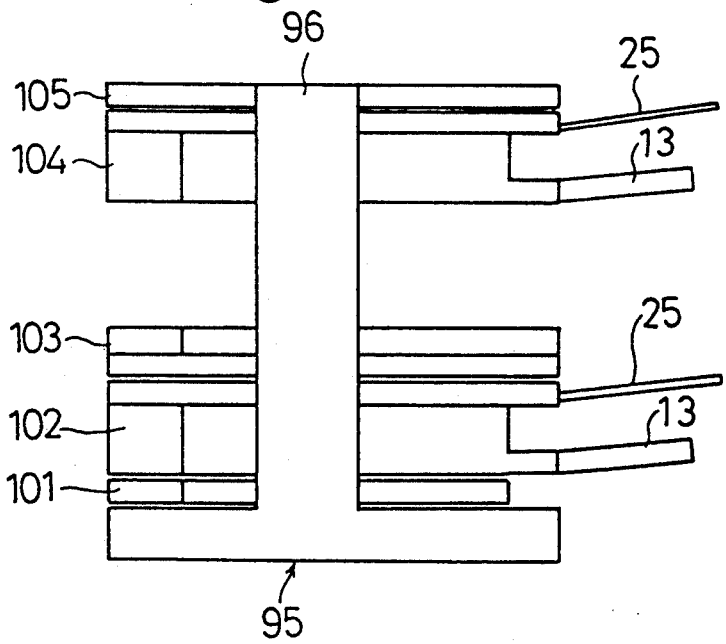
FIG. 33 is the whole front view showing an image forming apparatus wherein an upper unit stacked above a certain unit is retracted upward.

With the constructions as described above, when jam clearing and maintenance operation are conducted in each image forming unit section and paper transport unit section, as shown in FIG. 33, a locked state of engagement is released by a solenoid 24, and then, upper units above the dividing section (104, 105 in the figure) are driven upward by the driving motor 13 and retaracted. At the retracted position, the shaft of the solenoid 110 is brought in engagement with the positioning member 108 and the retracted units are retained thereat leaving no obstacle so that various operations can be performed easily. After completion of the maintenance operation, the engagement by the solenoid 110 is released to drive the retracted units 104, 105 downward by the driving motor 113, and the units 101–105 can be connected as shown in FIG. 32. At this stage, the engaging member 120 is moved by the engaging pieces 118 against the spring 123 to be automatically locked, and the state of engagement is detected by the dog 119 and the sensor 125 or 126 to be ready for image forming operations.

The present invention is not limited to the embodiments described above. For instance, the retracting mechanisms in the first through fourth embodiments may be applied to the retracting mechanism of each unit 101–105 in the fifth embodiment. Conversely, in an image forming apparatus wherein image forming unit 1 (1*a*–1*c*) and paper transport unit 2 (2*a*–2*c*) are stacked as described in the first through fourth embodiments, it may be arranged to apply a vertical elevating method of retracting action as in the fifth embodiment. Various retracting mechanisms may further be adopted for opening the upper space.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. An image forming apparatus, comprising:

a plurality of units including at least one image forming unit;

each one of the units having a transport path for conveying a sheet, while the image forming unit having image forming means for forming images on a sheet being conveyed onto the transport path;

support means for relatively movably supporting at least one of the image forming units between a first position and a second position, each of the units being arranged adjacent to each other in the vertical direction with the transport path of each unit being connected to the transport path of another adjoining unit at the first position, while at the second position, a space is formed in the upper portion of a unit immediately above which an image forming unit is moved; and detecting means for detecting the image forming unit when it is positioned at the first position.

2. An image forming apparatus having at least two image forming units, each unit having a sheet transport path and image forming means and being vertically arranged mutually, and each of the image forming means being connected through the sheet transport path, comprising:

a first image forming unit;

a second image forming unit positioned above the first image forming unit;

first holding means for holding the second image forming unit at a first position which is adjacent to the upper surface of the first image forming unit so that the sheet transport path of the first image forming unit and the sheet transport path of the second image forming unit are connected to convey a sheet on which images are formed by image forming means of the first image forming unit to the image forming means of the second image forming unit;

second holding means for holding the second image forming unit at a second position which is positioned away from the upper surface of the first image forming unit; and support means for movably supporting the second image forming unit between the first position and the second position, wherein the sheet transport path of the first image forming unit is exposed by upwardly opening the upper portion of the unit when the second image forming unit is positioned at the second position.

3. The image forming apparatus as defined in claim 2, further having a third holding means for holding the second image forming unit at a third position between the first position and the second position.

4. The image forming unit as defined in claim 2, further having energizing means for energizing the second image forming unit to move away from the upper surface of the first image forming unit at least when the second image forming unit is positioned between the first position and the second position.

5. The image forming apparatus as defined in claim 2, having detecting means for detecting the second image forming unit of said image forming apparatus when it is positioned at the first position.

6. The image forming apparatus as defined in claim 5, having means for prohibiting image forming operations at least by the first image forming unit when the second image forming unit is not detected at the first position by the detecting means.

7. The image forming apparatus as defined in claim 5, having means for prohibiting sheet transportation from the first image forming unit to the second image forming unit when the second image forming unit is not detected at the first position by the detecting means.

8. The image forming apparatus as defined in claim 5, having means for changing the sheet transport path in the first image forming unit when the second image forming unit is not detected at the first position by the detecting means.

9. A printer support device for supporting a plurality of printers vertically arranged, each printer having a sheet transport path and image forming means, comprising:

a first holding means for holding a first printer at a predetermined position;

a second holding means for holding a second printer;

means for movably supporting the second holding means;

a first fixing means for fixing the second holding means at a first position whereat the second printer is disposed immediately above the first printer, and the sheet transport paths of the first printer and the second printer are connected to convey a sheet on which an image is formed by image forming means of one of the printers to the image forming means of another one of the printers; and a second fixing means for fixing the second holding means at a second position which is different from the first position.

10. The image forming apparatus as defined in claim 9, wherein the second position is a position above the first position.

11. The image forming apparatus as defined in claim 10, having means for regulating a range of movement of the second holding means.

12. A printer support device for supporting a plurality of printers vertically arranged, comprising:

menas for positioning a first printer relative to the printer support device;

means for supporting a second printer so that the second printer is movable between a first position whereat the second printer is disposed immediately above the first printer and a second position whereat the second printer is distant from the upper surface of the first printer; and fixing means for fixing the second printer at the second position, wherein when the second printer is at the first position, sheet transport paths of the first printer and the second printer are connected to convey a sheet on which an image is formed by one of the printers to another one of the printers.

* * * * *